US007090036B2

(12) United States Patent
deBoer

(10) Patent No.: US 7,090,036 B2
(45) Date of Patent: Aug. 15, 2006

(54) SYSTEM FOR DRILLING OIL AND GAS WELLS BY VARYING THE DENSITY OF DRILLING FLUIDS TO ACHIEVE NEAR-BALANCED, UNDERBALANCED, OR OVERBALANCED DRILLING CONDITIONS

(76) Inventor: Luc deBoer, 7516 Olympia, Houston, TX (US) 77063

( * ) Notice: Subject to any disclaimer, the term of this patent is extended or adjusted under 35 U.S.C. 154(b) by 0 days.

(21) Appl. No.: 10/622,025

(22) Filed: Jul. 17, 2003

(65) Prior Publication Data

US 2004/0060737 A1 Apr. 1, 2004

Related U.S. Application Data

(63) Continuation-in-part of application No. 10/390,528, filed on Mar. 17, 2003, now Pat. No. 6,926,101, which is a continuation-in-part of application No. 10/289,505, filed on Nov. 6, 2002, now Pat. No. 6,843,331, which is a continuation-in-part of application No. 09/784,367, filed on Feb. 15, 2001, now Pat. No. 6,536,540.

(51) Int. Cl.
*C09K 8/32* (2006.01)

(52) U.S. Cl. ..... 175/70; 175/7; 175/66

(58) Field of Classification Search ..... 175/5, 175/7, 65, 70, 206, 207, 66; 166/357, 358
See application file for complete search history.

(56) References Cited

U.S. PATENT DOCUMENTS 1,585,969 A * 5/1926 Ferguson ..... 175/70
3,603,409 A 9/1971 Watkins
4,099,583 A 7/1978 Maus
4,291,772 A 9/1981 Beynet
4,624,327 A * 11/1986 Reichman ..... 175/67
5,873,420 A 2/1999 Gearhart
6,152,246 A 11/2000 King
6,179,071 B1 1/2001 Dietzen
6,230,824 B1 * 5/2001 Peterman et al. ..... 175/214
6,530,437 B1 * 3/2003 Maurer et al. ..... 175/5

* cited by examiner

*Primary Examiner*—David Bagnell
*Assistant Examiner*—G M Collins
(74) *Attorney, Agent, or Firm*—Jackson Walker L.L.P.; Mark A. Tidwell, Esq.

(57) ABSTRACT

A system for controlling drilling mud density at a location either at the seabed (or just above the seabed) or alternatively below the seabed of wells in offshore and land-based drilling applications is disclosed. The present invention combines a base fluid of lesser/greater density than the drilling fluid required at the drill bit to drill the well to produce a combination return mud in the riser. By combining the appropriate quantities of drilling mud with a light base fluid, a riser mud density at or near the density of seawater may be achieved to facilitate transporting the return mud to the surface. Alternatively, by injecting the appropriate quantities of heavy base fluid into a light return mud, the column of return mud may be sufficiently weighted to protect the wellhead. At the surface, the combination return mud is passed through a treatment system to cleanse the mud of drill cuttings and to separate the drilling fluid from the base fluid. The present invention further includes a control unit for manipulating drilling fluid systems and displaying drilling and drilling fluid data.

6 Claims, 16 Drawing Sheets

Light Fluid Injection at 800ft below Surface / ERD or Horizontal Drilling with Viscous base fluid and dilute with Heavy Fluid at 4,000ft

SYSTEM FOR DRILLING OIL AND GAS WELLS BY VARYING THE DENSITY OF DRILLING FLUIDS TO ACHIEVE NEAR-BALANCED, UNDERBALANCED, OR OVERBALANCED DRILLING CONDITIONS

CROSS-REFERENCE TO RELATED APPLICATIONS

The present application is a continuation-in-part of U.S. patent application Ser. No. 10/390,528 filed on Mar. 17, 2003 now U.S. Pat. No. 6,926,101, which is a continuation-in-part of U.S. patent application Ser. No. 10/289,505 filed on Nov. 6, 2002 now U.S. Pat. No. 6,843,331, which is a continuation-in-part of U.S. patent application Ser. No. 10/289,505 filed on Nov. 6, 2002 now U.S. Pat. No. 6,843,331, which is a continuation-in-part of U.S. patent application Ser. No. 09/784,367, filed on Feb. 15, 2001, now U.S. Pat. No. 6,536,540.

BACKGROUND OF THE INVENTION

1. Field of the Invention

The subject invention is generally related to systems for delivering drilling fluid (or "drilling mud") for oil and gas drilling applications. More particularly, the present invention is directed to a system for controlling the density and flow of drilling mud in offshore (deep and shallow water) and land-based oil and gas drilling applications.

2. Description of the Prior Art

It is well known to use drilling mud to provide hydraulic horse power for operating drill bits, to maintain hydrostatic pressure, to cool the wellbore during drilling operations, and to carry away particulate matter when drilling for oil and gas in subterranean wells. In basic operations, drilling mud is pumped down the drill pipe to provide the hydraulic horsepower necessary to operate the drill bit, and then it flows back up from the drill bit along the periphery of the drill pipe and inside the open borehole and casing. The returning mud carries the particles loosed by the drill bit (i.e., "drill cuttings") to the surface. At the surface, the return mud is cleaned to remove the particles and then is recycled down into the hole.

The density of the drilling mud is monitored and controlled in order to maximize the efficiency of the drilling operation and to maintain hydrostatic pressure. In a typical application, a well is drilled using a drill bit mounted on the end of a drill stem inserted down the drill pipe. The drilling mud is pumped down the drill pipe and through a series of jets in the drill bit to provide a sufficient force to drive the bit. A gas flow and/or other additives are also pumped into the drill pipe to control the density of the mud. The mud passes through the drill bit and flows upwardly along the drill string inside the annulus formed between the open hole or cased hole and the drill string, carrying the loosened particles to the surface.

Besides the density, the velocity or rate of the return mud flow must also be monitored and controlled. The rate at which the return mud flows upward through the annulus between the open/cased hole and the drill string is referred to as the "annular velocity." The annular velocity of the return mud is commonly expressed in units of feet per minute (FPM) and is a function of the cross-sectional area of the annular space between the hole and the drill string. If this cross-sectional area is reduced, then the annular velocity of the return mud flowing through that area will naturally increase. Typically, this is problematic where the hole diameter is large—such as the surface casing hole. Typically the first borehole(s) drilled just below the seabed range between 12" and 18" in diameter. Since conventional drill strings are composed of drill pipes having an outer diameter ranging from 2⅞" to 6⅝", the annular space between the drill pipe and the wellbore is relatively large. This results in a slower annular velocity for return mud flowing through these zones.

The annular velocity of the return mud must be monitored for at least two important reasons. First, the annular velocity of the return mud must be maintained to be greater than the rate at which the cuttings and debris being carried by the mud slip downward due to the effects of gravity. This is referred to as "critical velocity." If the annular velocity of the return mud falls below the critical rate, then there will be a risk that the cuttings and debris particles will slip and settle thus forming bridges that may obstruct the wellbore. Furthermore, the annular velocity of the return mud must be maintained at a laminar level to avoid turbulent flow which could be damaging to the formation itself.

One example of a mud control system is shown and described in U.S. Pat. No. 5,873,420, entitled "Air and Mud Control System for Underbalanced Drilling", issued on Feb. 23, 1999 to Marvin Gearhart. The system shown and described in the Gearhart patent provides for a gas flow in the tubing for mixing the gas with the mud in a desired ratio so that the mud density is reduced to permit enhanced drilling rates by maintaining the well in an underbalanced condition.

It is known that there is a preexistent pressure on the formations of the earth, which, in general, increases as a function of depth due to the weight of the overburden on particular strata. This weight increases with depth so the prevailing or quiescent bottom hole pressure is increased in a generally linear curve with respect to depth. As the well depth is doubled in a normal-pressured formation, the pressure is likewise doubled. This is further complicated when drilling in deep water or ultra deep water because of the pressure on the sea floor by the water above it. Thus, high pressure conditions exist at the beginning of the hole and increase as the well is drilled. It is important to maintain a balance between the mud density and pressure and the hole pressure. Otherwise, the pressure in the hole will force material back into the wellbore and cause what is commonly known as a "kick." In basic terms, a kick occurs when the gases or fluids in the wellbore flow out of the formation into the wellbore and bubble upward. When the standing column of drilling fluid is equal to or greater than the pressure at the depth of the borehole, the conditions leading to a kick are minimized. When the mud density is insufficient, the gases or fluids in the borehole can cause the mud to decrease in density and become so light that a kick occurs.

Kicks are a threat to drilling operations and a significant risk to both drilling personnel and the environment. Typically blowout preventers (or "BOP's") are installed at the ocean floor or at the surface to contain the wellbore and to prevent a kick from becoming a "blowout" where the gases or fluids in the wellbore overcome the BOP and flow upward creating an out-of-balance well condition. However, the primary method for minimizing the risk of a blowout condition is the proper balancing of the drilling mud density to maintain the well in a balanced condition at all times. While BOP's can contain a kick and prevent a blowout from occurring thereby minimizing the damage to personnel and the environment, the well is usually lost once a kick occurs, even if contained. It is far more efficient and desirable to use proper mud control techniques in order to reduce the risk of a kick than it is to contain a kick once it occurs.

In order to maintain a safe margin, the column of drilling mud in the annular space around the drill stem is of sufficient weight and density to produce a high enough pressure to limit risk to near-zero in normal drilling conditions. This is referred to as "overbalanced" drilling. In an overbalanced state, the hydrostatic pressure induced by the weight of the drilling fluid is greater than the actual pore pressure of the reservoir formation. However, during overbalanced drilling, the drilling mud may penetrate the formation from the wellbore. Moreover, overbalanced drilling slows down the drilling process.

Alternatively, in some cases, underbalanced drilling has been attempted in order to increase the drilling rate and to reduce drilling mud penetration into the formation. In an underbalanced state, the hydrostatic pressure induced by the weight of the drilling fluid in the well is less than the actual formation pressure within the pore spaces of the reservoir formation. Accordingly, during underbalanced drilling, the fluids within the pore spaces of the reservoir formation actually flow into the wellbore. As such, underbalanced drilling presents significant benefits: (1) the rate of penetration or speed of well construction is increased, (2) the incidence of drill pipe sticking is decreased, and (3) the risk of losing expensive drilling into the formation is practically eliminated.

Furthermore, deep water and ultra deep water drilling has its own set of problems coupled with the need to provide a high density drilling mud in a wellbore that starts several thousand feet below sea level. The pressure at the beginning of the hole is equal to the hydrostatic pressure of the seawater above it, but the mud must travel from the sea surface to the sea floor before its density is useful. It is well recognized that it would be desirable to maintain mud density at or near seawater density (or 8.6 PPG) when above the borehole and at a heavier density from the seabed down into the well. In the past, pumps have been employed near the seabed for pumping out the returning mud and cuttings from the seabed above the BOP's and to the surface using a return line that is separate :from the riser. This system is expensive to install, as it requires separate lines, expensive to maintain, and very expensive to run. Another experimental method employs the injection of low density particles—such—as glass beads into the returning fluid in the riser above the sea floor to reduce the density of the returning mud as it is brought to the surface. Typically, the BOP stack is on the sea floor and the glass beads are injected above the BOP stack.

While it has been proven desirable to control drilling mud density and flow in a wellbore, during the drilling of oil and gas wells there are no prior art systems that effectively accomplish this objective. The present invention provides such a system.

SUMMARY OF THE INVENTION

The present invention is directed at a system for controlling drilling mud density in land-based and offshore (shallow water, deep water or ultra deep water) drilling applications.

It is an important aspect of the present invention that the drilling mud is diluted using a base fluid. The base fluid may be of lesser density or greater density than the drilling mud required at the wellhead. The base fluid and drilling mud are combined to yield a diluted mud.

In one embodiment of the present invention, the base fluid has a density less than seawater (or less than 8.6 PPG). By combining the appropriate quantities of drilling mud with base fluid, a riser mud density at or near the density of seawater may be achieved. It can be assumed that the base fluid is an oil base having a density of approximately 6.5 PPG. Using an oil base mud system, for example, the mud may be pumped from the surface through the drill string and into the bottom of the wellbore at a density of 12.5 PPG, typically at a rate of around 800 gallons per minute in a 12-¼ inch hole. The fluid in the riser, which is at this same density, is then diluted above the sea floor or alternatively below the sea floor with an equal amount or more of base fluid through the riser charging lines. The base fluid is pumped at a faster rate, say 1500 gallons per minute, providing a return fluid with a density that can be calculated as follows:

$$[(F_{Mi}\times Mi)+(F_{Mb}\times Mb)]/(F_{Mi}+F_{Mb})=Mr,$$

where:

FM=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

Mr=((800×12.5)+(1500×6.5))/(800+1500)=8.6 PPG. The flow rate, $F_r$, of the mud having the density Mr in the riser is the combined flow rate of the two flows, $F_i$, and $F_b$. In the example, this is:

$$F_r=F_i+F_b=800\text{ gpm}+1500\text{ gpm}=2300\text{ gpm}.$$

The return flow in the riser is a mud having a density of 8.6 PPG (or the same as seawater) flowing at 2300 gpm.

In another embodiment of the present invention, the density of the drilling fluid being circulated through the drill bit is less than the density of the base fluid being inserted into the return mud. In cases where it is necessary or advantageous to drill with a non-damaging, low density fluid (e.g., in the production zone) to achieve a near-balanced or slightly underbalanced state, the return mud must still be weighted down above the reservoir to maintain hydrostatic pressure and to take pressure off of the wellhead. Accordingly, a base fluid having a greater density than the light drilling fluid is injected into the wellbore at a location below the wellhead to add weight to the return mud.

It is another important aspect of the present invention that the return flow is treated at the surface in accordance with the mud treatment system of the present invention. The mud is returned to the surface and the cuttings are separated from the mud using a shaker device. While the cuttings are transported in a chute to a dryer (or alternatively discarded overboard), the cleansed return mud falls into riser mud tanks or pits. The return mud pumps are used to carry the drilling mud to a separation skid which is preferably located on the deck of the drilling rig. The separation skid includes: (1) return mud pumps, (2) a centrifuge device to strip the base fluid having density Mb from the return mud to achieve a drilling fluid with density Mi, (3) a base fluid collection tank for gathering the lighter base fluid stripped from the drilling mud, and (4) a drilling fluid collection tank to gather the heavier drilling mud having a density Mi. Holding tanks (e.g., hull tanks) for storing the base fluid are located beneath the separation skid such that the base fluid can flow from the stripped base fluid collection tank into the holding tank. A conditioning tank is located beneath the separation skid such that the stripped drilling fluid can flow from the drilling fluid collection tank into conditioning tanks. Once the drilling fluid is conditioned in the conditioning tanks, the drilling fluid flows into active tanks located below the conditioning tanks. As needed, the cleansed and stripped drilling fluid can be returned to the drill string via a mud manifold using the mud pumps, and the base fluid can be re-inserted into the riser stream via charging lines or choke and kill lines, or alternatively into a concentric riser using base fluid pumps.

It is yet another important aspect of the present invention that the mud recirculation system includes a multi-purpose control unit for manipulating drilling fluid systems and displaying drilling and drilling fluid data.

It is an object and feature of the subject invention to provide a system for diluting mud density in land-based and offshore (i.e., shallow water, deep water, and ultra deep water) drilling applications for both drilling units and floating platform configurations.

It is another object and feature of the subject invention to provide a system for decreasing/increasing the density of mud in a riser by injecting low/high density fluids into the riser lines (typically the charging line or booster line or possibly the choke or kill line) or riser systems with surface BOP's.

It is also an object and feature of the subject invention to provide a system of decreasing/increasing the density of mud in a concentric riser system with subsea or surface BOP's.

It is yet another object and feature of the subject invention to provide a system for decreasing/increasing the density of mud in a riser by injecting low/high density fluids into the return mud stream via a below-seabed wellhead injection apparatus.

It is a further object and feature of the subject invention to provide a system for decreasing/increasing the density of mud in a riser by injecting low/high density fluids into the return mud stream via a string of concentric drill pipes.

It is yet a further object and feature of the present invention to increase the return mud annular velocity by providing an oversized drill pipe having an outer diameter ranging between 6¾" to 9⅞".

It is still a further object and feature of the subject invention to provide a system for separating the drilling fluid and the injected base fluid from one another at the surface.

Other objects and features of the invention will be readily apparent from the accompanying drawing and detailed description of the preferred embodiment.

DESCRIPTION OF A PREFERRED EMBODIMENT OF THE PRESENT INVENTION

Figure 1:
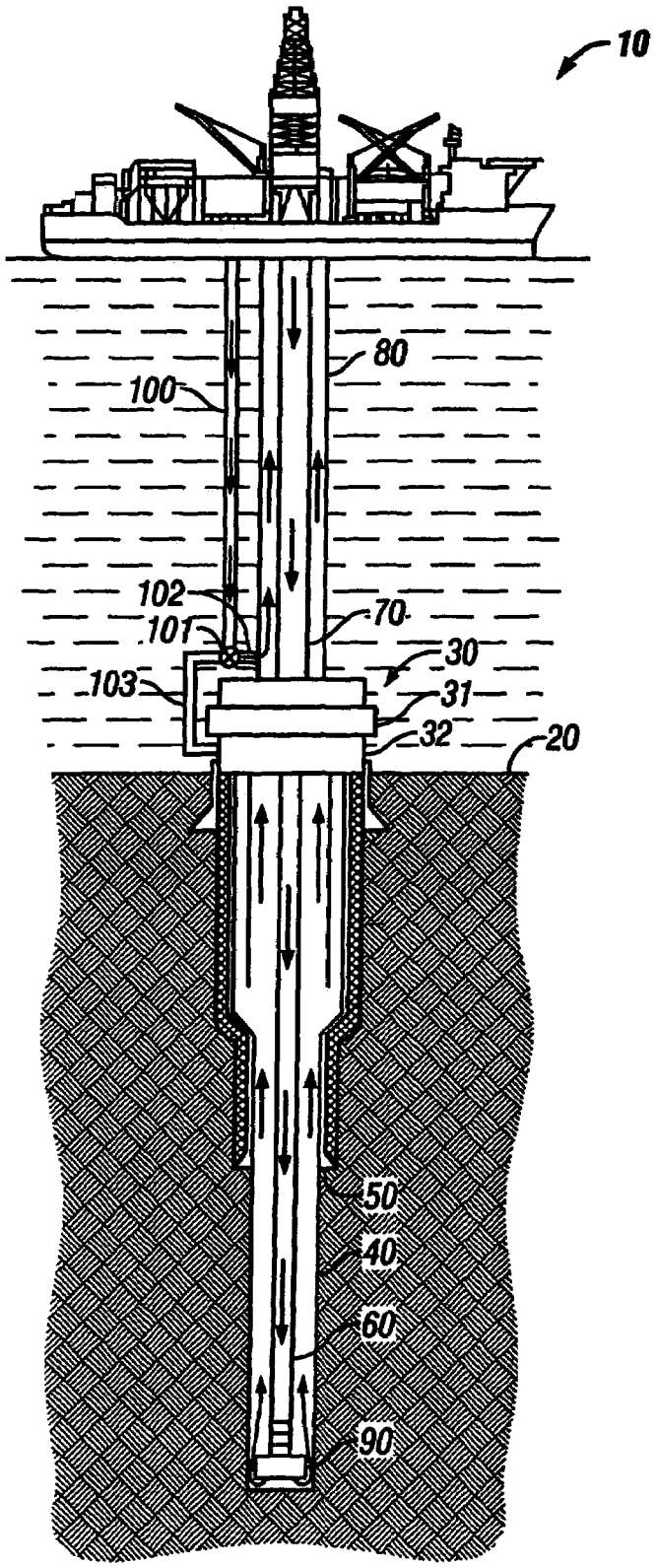
FIG. 1 is a schematic of a typical offshore drilling system modified to accommodate the teachings of the present invention depicting drilling mud being diluted with a base fluid at or above the seabed.
Figure 2:
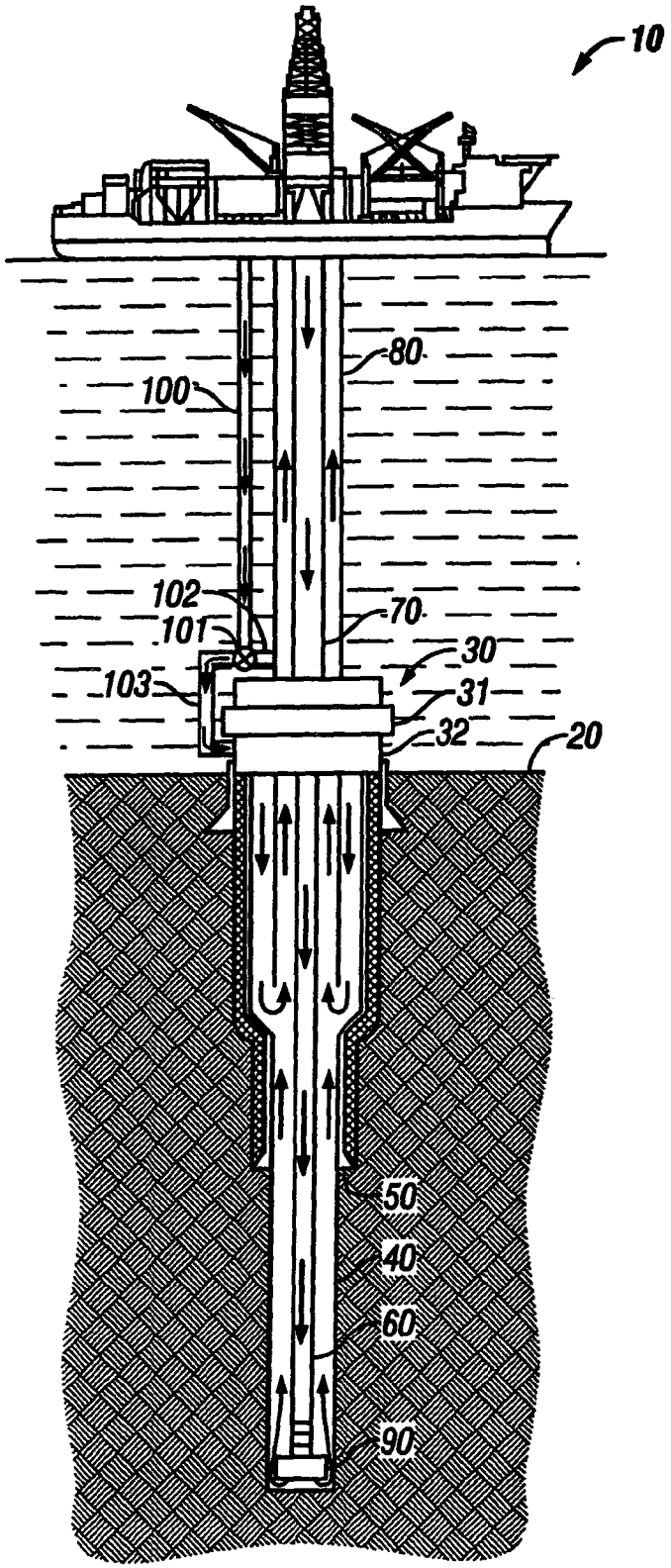
FIG. 2 is a schematic of a typical offshore drilling system modified to accommodate the teachings of the present invention depicting drilling mud being diluted with a base fluid below the seabed.

With respect to FIGS. 1–2, a mud recirculation system for use in deepwater (i.e., beyond the continental shelf) offshore drilling operations to pump drilling mud: (1) downward through a drill string to operate a drill bit thereby producing drill cuttings, (2) outward into the annular space between the drill string and the formation of the wellbore where the mud mixes with the cuttings, and (3) upward from the wellbore to the surface via a riser in accordance with the present invention is shown. A platform 10 is provided from which drilling operations are performed. The platform 10 may be an anchored floating platform or a drill ship or a semi-submersible drilling unit. A series of concentric strings runs from the platform 10 to the sea floor or seabed 20 and into a stack 30. The stack 30 is positioned above a wellbore 40 and includes a series of control components, generally including one or more blowout preventers or BOP's 31. The concentric strings include casing 50, tubing 60, a drill string 70, and a riser 80. A drill bit 90 is mounted on the end of the drill string 70. A riser charging line (or booster line) 100 runs from the surface to a switch valve 101. The riser charging line 100 includes an above-seabed section 102 running from the switch valve 101 to the riser 80 and a below-seabed section 103 running from the switch valve 101 to a wellhead injection apparatus 32. The above-seabed charging line section 102 is used to insert a base fluid into the riser 80 to mix with the upwardly returning drilling mud at a location at or above the seabed 20. The below-seabed charging line section 103 is used to insert a base fluid into the wellbore to mix with the upwardly returning drilling mud via a wellhead injection apparatus 32 at a location below the seabed 20. The switch valve 101 is manipulated by a control unit to direct the flow of the base fluid into either the above-seabed charging line section 102 or the below-seabed charging line section 103. While this embodiment of the present invention is described with respect to a deepwater offshore drilling rig platform, it is intended that the mud recirculation system of the present invention can also be employed for any offshore operation (shallow, deep, or ultra deep) and even land-based drilling operations.

With respect to FIG. 3, the wellhead injection apparatus 32 for injecting a base fluid into the drilling mud at a location below the seabed is shown. The injection apparatus 32 includes: (1) a wellhead connector 200 for connection with a wellhead 300 and having an axial bore therethrough and an inlet port 201 for providing communication between the riser charging line 100 (FIGS. 1 and 2) and the wellbore; and (2) an annulus injection sleeve 400 having a diameter less than the diameter of the axial bore of the wellhead connector 200 attached to the wellhead connector thereby creating an annulus injection channel 401 through which the base fluid is pumped downward. The wellhead 300 is supported by a wellhead body 302 which is cemented in place to the seabed.

In a preferred embodiment of the present invention, the wellhead housing 302 is a 36 inch diameter casing and the wellhead 300 is attached to the top of a 20 inch diameter casing. The annulus injection sleeve 400 is attached to the top of a 13-⅜ inch to 16 inch diameter casing sleeve having a 2,000 foot length. Thus, in this embodiment of the present invention, the base fluid is injected into the wellbore at a location approximately 2,000 feet below the seabed. While the preferred embodiment is described with casings and casing sleeves of a particular diameter and length, it is intended that the size and length of the casings and casing sleeves can vary depending on the particular drilling application.

Figure 3:
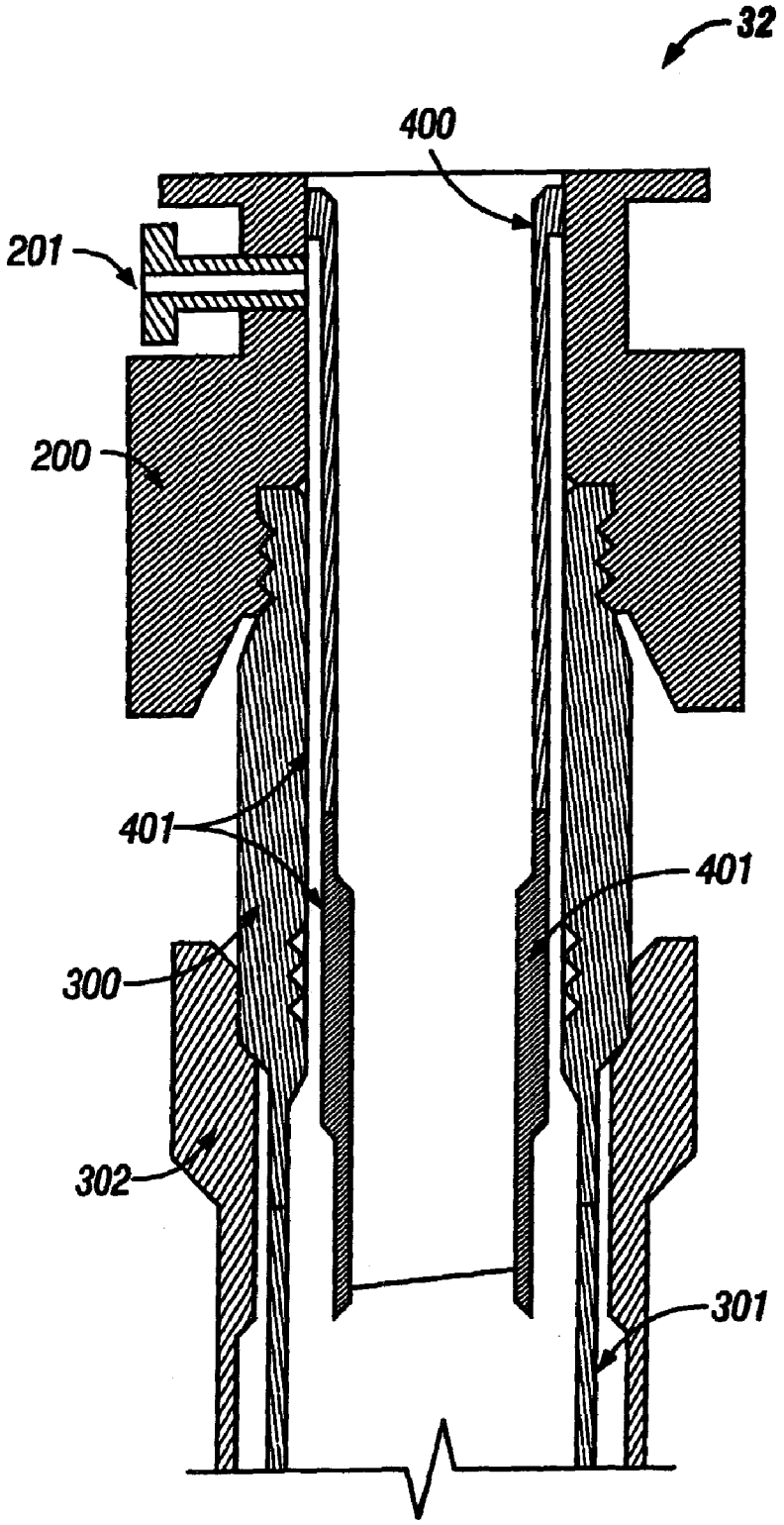
FIG. 3 is an enlarged sectional view of a below-seabed wellhead injection apparatus in accordance with the present invention for injecting a base fluid into drilling mud below the seabed.

In operation, with respect to FIGS. 1–3, drilling mud is pumped downward from the platform 10 into the drill string 70 to turn the drill bit 90 via the tubing 60. As the drilling mud flows out of the tubing 60 and past the drill bit 90, it flows into the annulus defined by the outer wall of the tubing 60 and the formation 40 of the wellbore. The mud picks up the cuttings or particles loosened by the drill bit 90 and carries them to the surface via the riser 80. A riser charging line 100 is provided for charging (i.e., circulating) the fluid in the riser 80 in the event a pressure differential develops that could impair the safety of the well.

In accordance with an embodiment of the present invention, when it is desired to dilute the rising drilling mud, a base fluid (typically, a light base fluid) is mixed with the drilling mud either at (or immediately above) the seabed or below the seabed. A reservoir contains a base fluid of lower density than the drilling mud and a set of pumps connected to the riser charging line (or booster charging line). This base fluid is of a low enough density that when the proper ratio is mixed with the drilling mud a combined density equal to or close to that of seawater can be achieved. When it is desired to dilute the drilling mud with base fluid at a location at or immediately above the seabed 20, the switch valve 101 is manipulated by a control unit to direct the flow of the base fluid from the platform 10 to the riser 80 via the charging line 100 and above-seabed section 102 (FIG. 1). Alternatively, when it is desired to dilute the drilling mud with base fluid at a location below the seabed 20, the switch valve 101 is manipulated by a control unit to direct the flow of the base fluid from the platform 10 to the riser 80 via the charging line 100 and below-seabed section 103 (FIG. 2).

In a typical example, the drilling mud is an oil based mud with a density of 12.5 PPG and the mud is pumped at a rate of 800 gallons per minute or "gpm". The base fluid is an oil base fluid with a density of 6.5 to 7.5 PPG and can be pumped into the riser charging lines at a rate of 1500 gpm. Using this example, a riser fluid having a density of 8.6 PPG is achieved as follows:

$$Mr=[(F_{Mi}\times Mi)+(F_{Mb}\times Mb)]/(F_{Mi}+F_{Mb}),$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

$$Mr=((800\times 12.5)+(1500\times 6.5))/(800+1500)=8.6\text{ PPG}.$$

The flow rate, $F_r$, of the mud having the density Mr in the riser is the combined flow rate of the two flows, $F_i$, and $F_b$. In the example, this is:

$$F_r=F_i+F_b=800\text{ gpm}+1500\text{ gpm}=2300\text{ gpm}.$$

The return flow in the riser above the base fluid injection point is a mud having a density of 8.6 PPG (or close to that of seawater) flowing at 2300 gpm.

Although the example above employs particular density values, it is intended that any combination of density values may be utilized using the same formula in accordance with the present invention.

Figure 4:
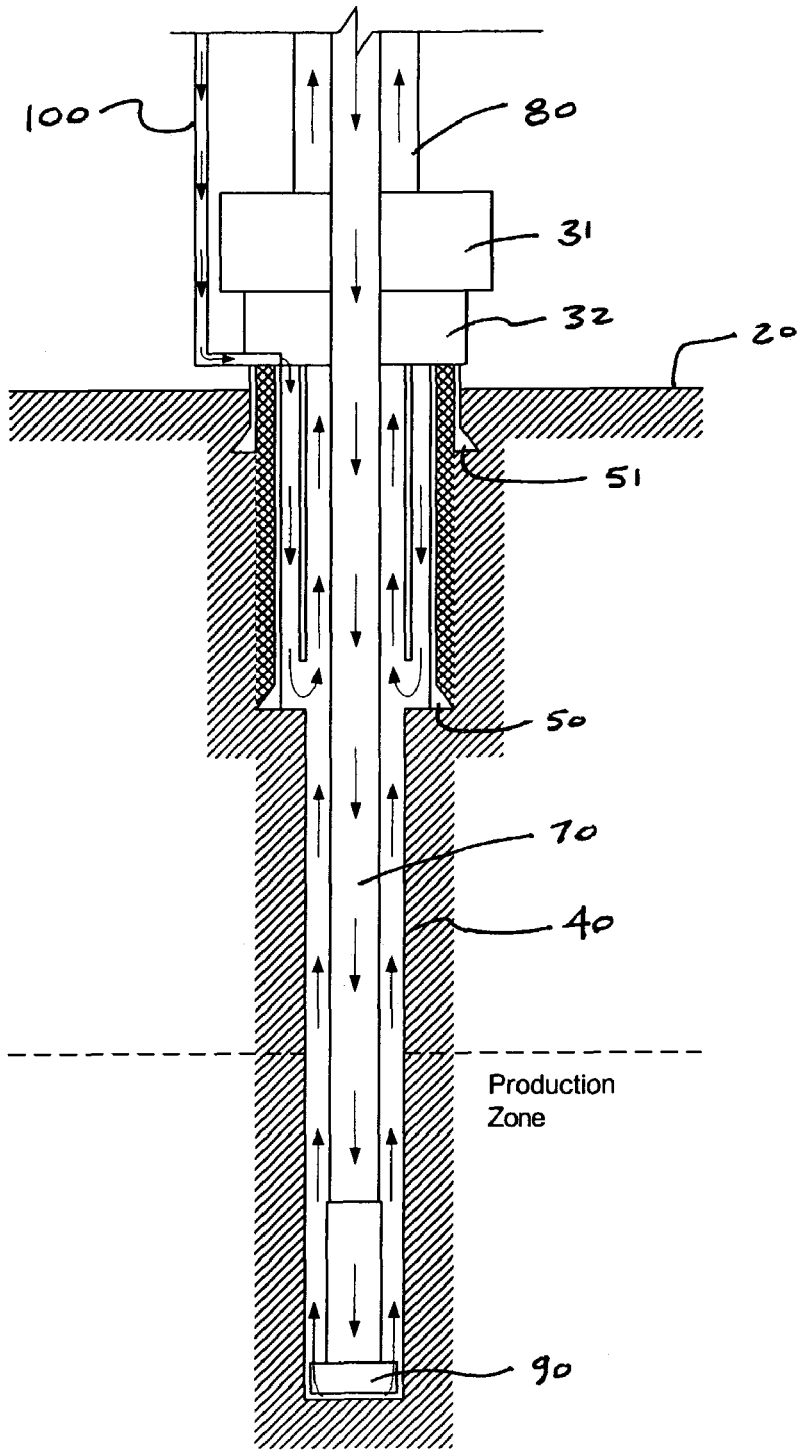
FIG. 4 is a schematic of an offshore drilling system depicting a vertical well being drilled by running a light mud through the drill bit and injecting a heavy mud over the column of light return mud.
Figure 5:
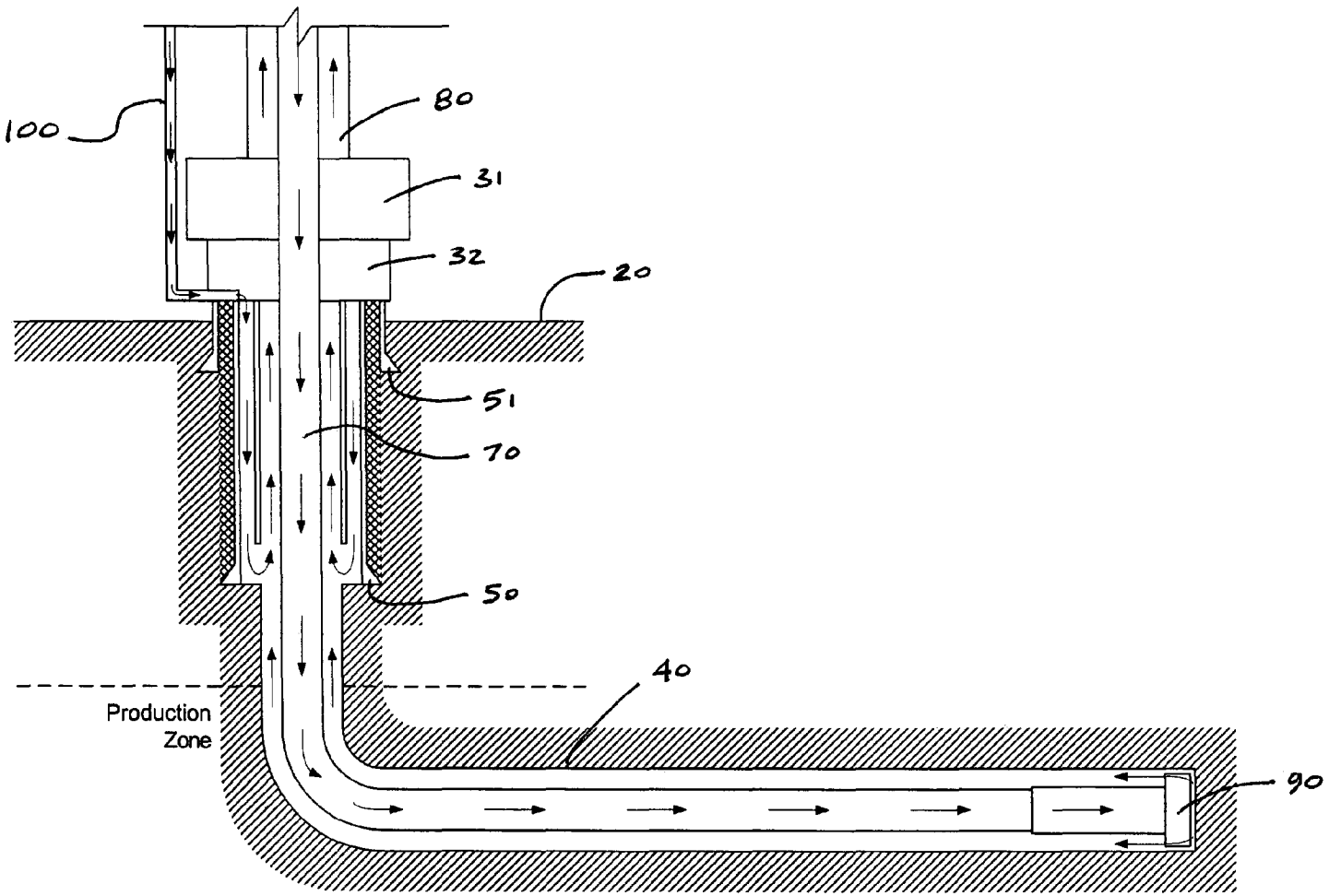
FIG. 5 is a schematic of an offshore drilling system depicting a horizontal section of a well being drilled by running a light mud through the drill bit and injecting a heavy mud over the column of light return mud.

In another embodiment of the present invention, the wellbore is drilled as described above (using a light base fluid injected into the return mud stream) until the production zone is reached. The production zone may be drilled through with a vertical section (as shown in FIG. 4) or a horizontal section (as shown in FIG. 5). At this point, it may be desirable to drill with a light, clean drilling fluid to prevent contamination of the reservoir or damage to the formation. Accordingly, the well in this section may be drilled in a near-balanced (i.e., slightly underbalanced or slightly overbalanaced) or underbalanced state such that the drilling fluid does not penetrate the formation.

With respect to FIGS. 4 and 5, the mud control system includes a BOP 31 connected to a wellhead injection apparatus 32. A riser 80 is provided to establish communication between the surface and the wellbore 40. A drill bit 90 is mounted on the end of the drill string 70. A riser charging line (or booster line) 100 runs from the surface to the well head injection apparatus 32. While this embodiment of the present invention is described with respect to a deepwater offshore drilling rig platform, it is intended that the mud recirculation system of the present invention can also be employed for any offshore operation (shallow, deep, or ultra deep) and even land-based drilling operations.

In operation, with respect to FIGS. 4 and 5, once the production zone is reached, a light, clean drilling fluid is pumped downward into the drill string 70 to turn the drill bit 90 and circulate into the borehole 40. The drilling fluid then flows into the annulus defined by the outer wall of the drill string 70 and the formation 40. At this point, the production zone section of the wellbore is near-balanced or underbalanced such that the drilling fluid does not penetrate or contaminate the reservoir. The drilling fluid picks up the cuttings or particles loosened by the drill bit 90 and carries them upward toward the surface. As the return mud reaches the wellhead injection apparatus 32, a base fluid having a density greater than the light drilling fluid is injected into the return mud to create a sufficiently dense combination fluid. This combination fluid may then pass into the riser 80 and return to the surface for treatment and separation without damaging the wellhead and thus impairing the safety of the well.

While this system is described above for use once the production zone is reached, the light drilling fluid with heavy base fluid injection system may also be used for sand screen zones, multi-lateral sections, extended reach sections, horizontal sections, or any occasion where slightly underbalanced (or near balanced) drilling is desired.

Figure 6:
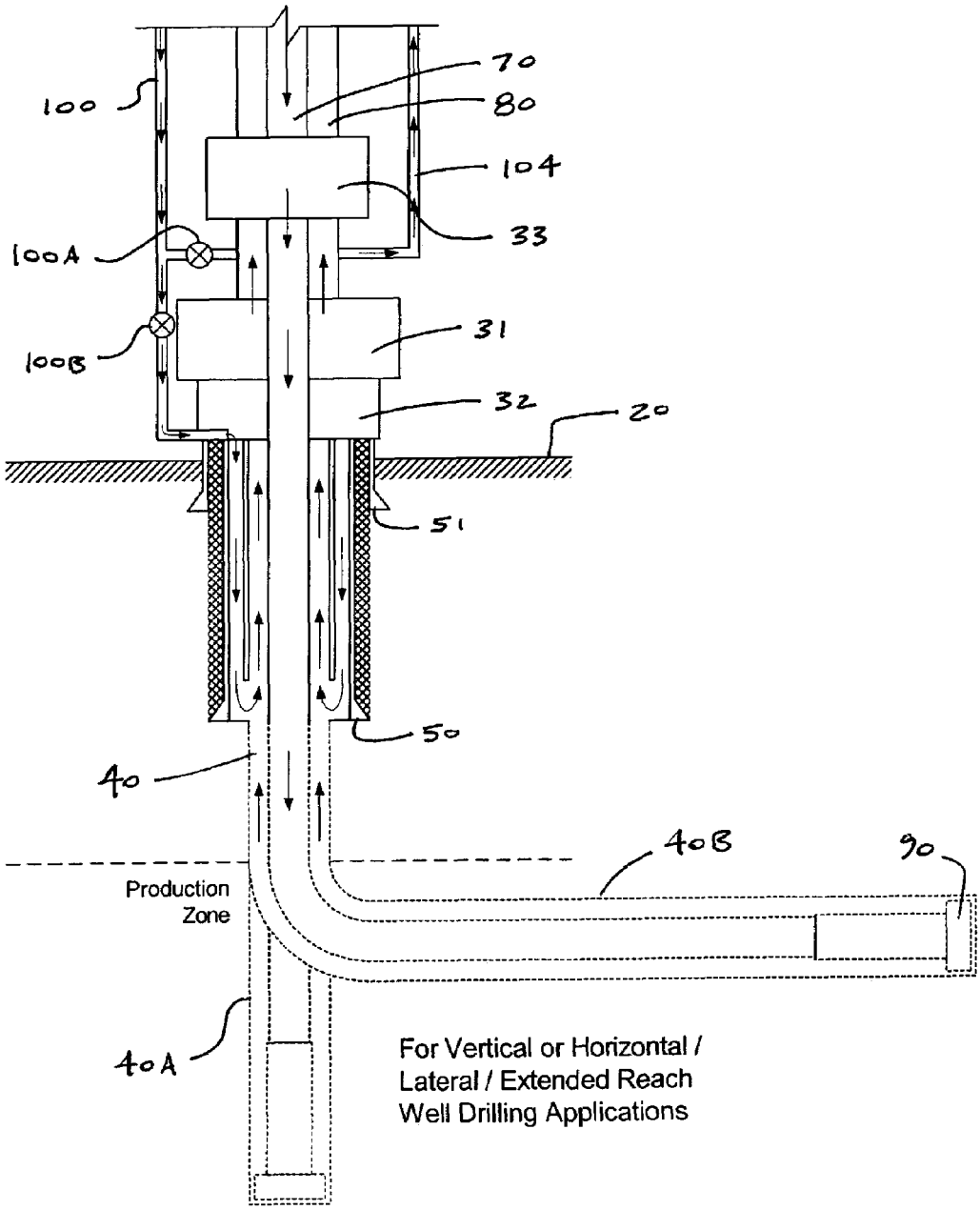
FIG. 6 is a schematic of an offshore drilling system depicting a horizontal section of a well or a vertical section of a well being drilled by running a light mud through the drill bit and injecting a heavy mud over the column of light return mud and including a rotating head to control formation pressures to facilitate underbalanced drilling.

With respect to FIG. 6, another embodiment of the mud control system of the present invention includes a rotating head 33 for closing around the drill string 70 and containing the pressure in the wellbore 40 under controlled conditions. The rotating head 33 controls the direction of the return mud stream as it flows to the surface by making a rotating seal around the drill string when actuated. This seal forces the return mud away from the riser 80. This system may be used in both the drilling of vertical well sections 40A and horizontal well sections 40B.

This embodiment of the mud control system further includes a booster line (or charging line) 100 for delivering the base fluid to the well and a return line (or choke line) 104 for delivering the return mud to the surface when the rotating head 33 is actuated. The booster line 100 includes: (1) a first valve-controlled section 100A for delivering a light base fluid directly to the riser 80 under the rotating head 33 to lighten the return mud flowing through the return line 104 when the rotating head is actuated, and a second valve-controlled section 100B for delivering a light base fluid (if drilling overbalanced above the production zone) or a heavy base fluid (if drilling underbalanced or near-balanced through the production zone) to the borehole annulus.

While the above-described embodiments of the wellhead injection apparatus of the present invention include only one injection point, it is intended that other embodiments of the wellhead injection apparatus may include a plurality of axially spaced injection points which may be regulated by valves controlled at the surface or by convention drop ball actuation. Each valve may be moved between an open position to facilitate base fluid injection or a closed position to block injection.

Figure 7A:
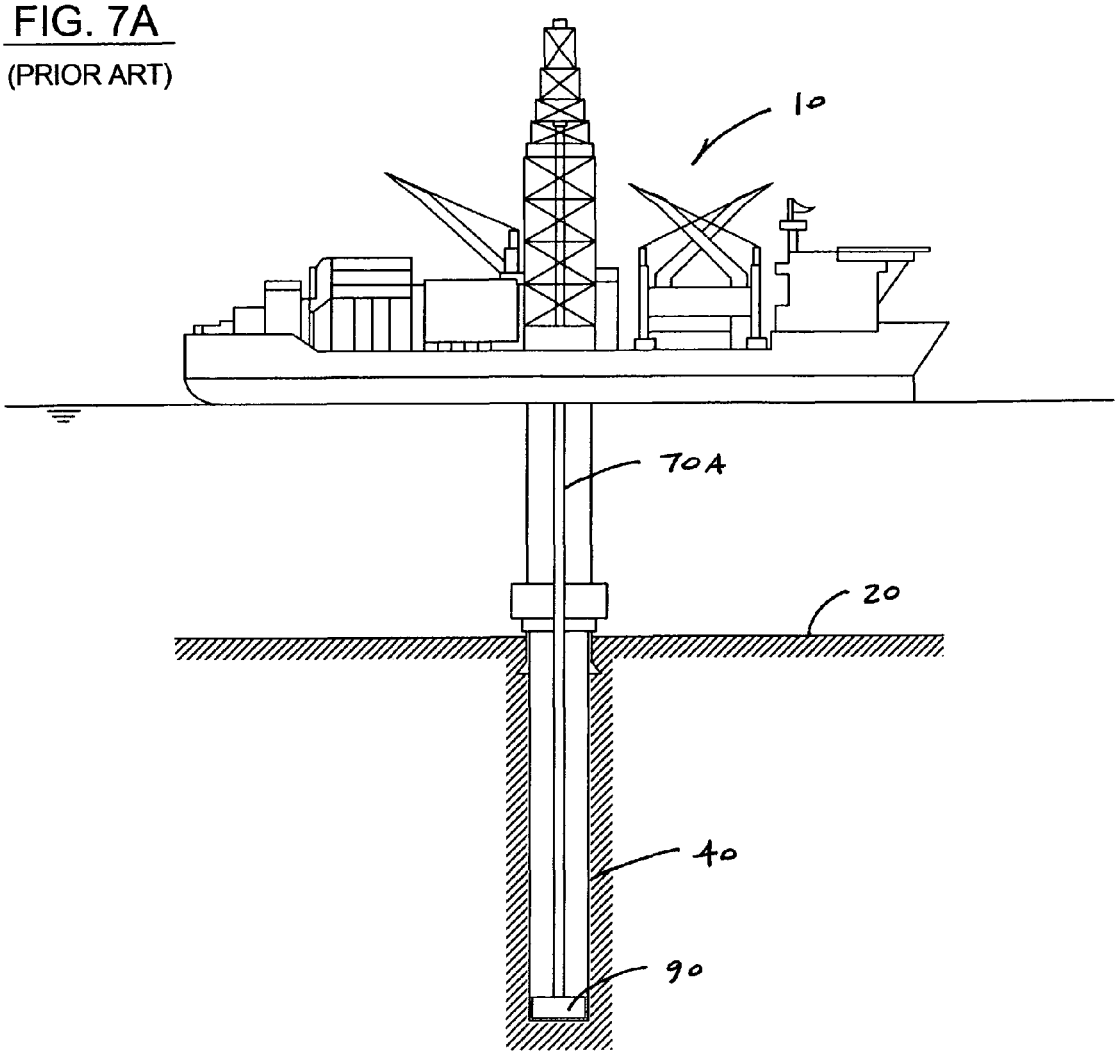
FIG. 7A (PRIOR ART)
FIG. 7A is a schematic of an offshore drilling system depicting a prior art drill string comprising a string of drill pipes having an outer diameter range of 2⅞" to 6⅝".
Figure 7B:
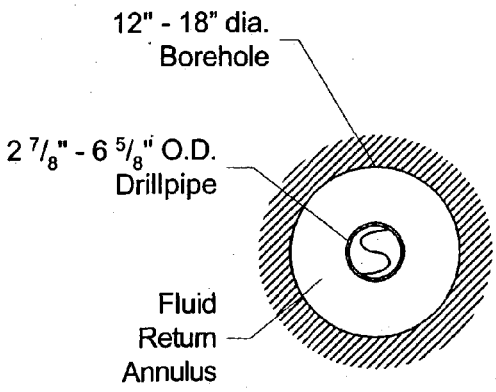
FIG. 7B (PRIOR ART)
FIG. 7B is an enlarged cross-sectional view of a prior art drill string comprising a string of drill pipes having an outer diameter range of 2⅞" to 6⅝".
Figure 8A:
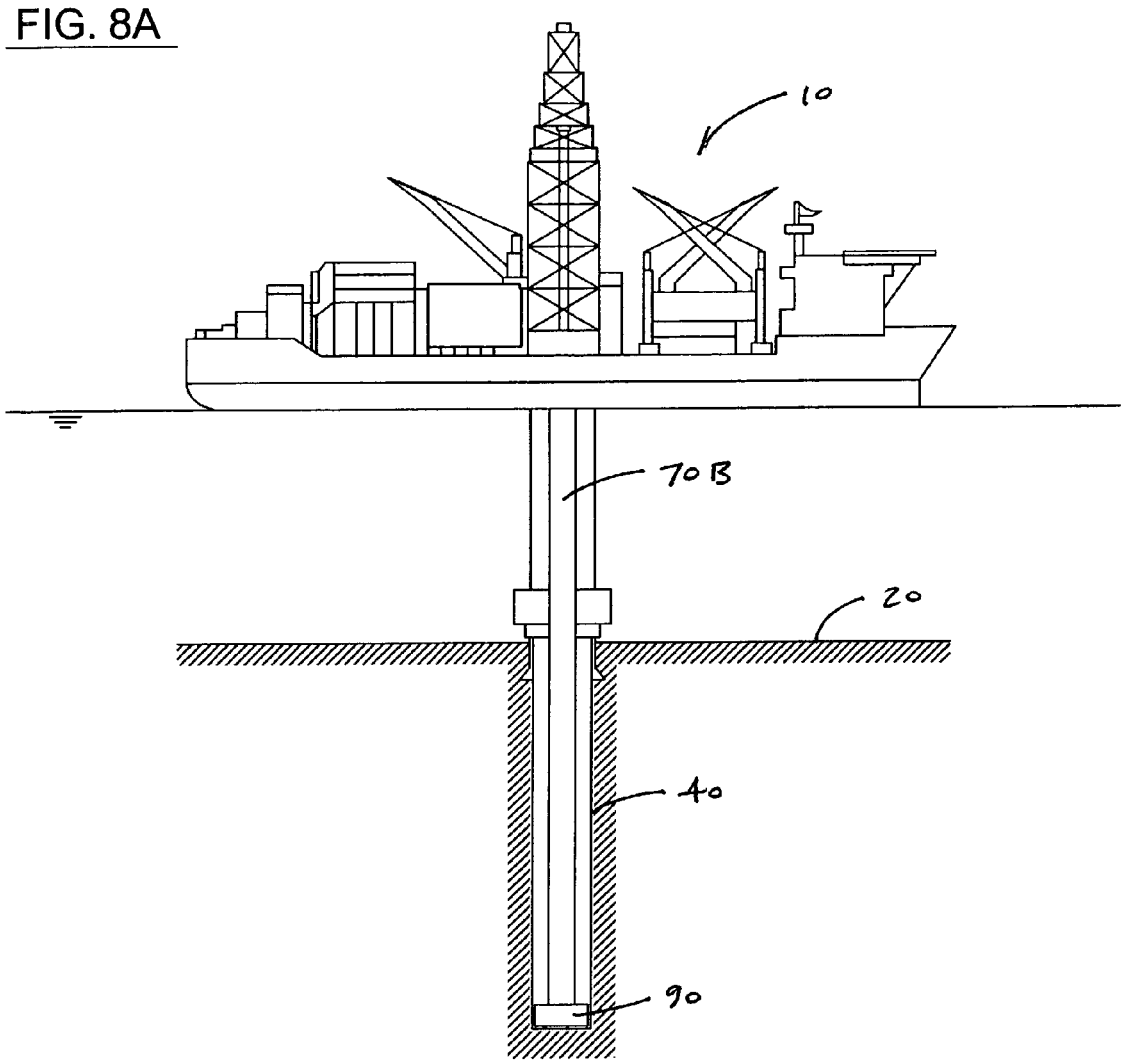
FIG. 8A is a schematic of an offshore drilling system depicting an oversized drill string in accordance with the present invention comprising a string of drill pipes having an outer diameter range of 6¾" to 9⅞".
Figure 8B:
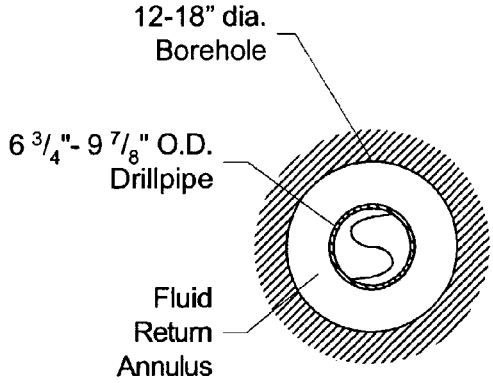
FIG. 8B is an enlarged cross-sectional view of an oversized drill string in accordance with the present invention comprising a string of drill pipes having an outer diameter range of 6¾" to 9⅞".

In still another embodiment of the present invention, the drill string used to deliver drilling fluid to the drill bit and the bottom of the hole may comprise a string of oversized drill pipes to increase the annular velocity of the return fluid. For example, with respect to FIGS. 7A and 7B, prior art drill pipes 70A have an outer diameter ranging from 2⅞" to 6⅝". These drill pipes are run through a surface casing borehole 40 having a diameter ranging from 12" to 18". With respect to FIGS. 8A and 8B, a drill string comprising a string of oversized drill pipes (i.e., having a diameter ranging from 6¾" to 9⅞") would provide a smaller annular space between the borehole 40 and the drill string 70B. Thus, a higher annular velocity for the return mud can be achieved. The diameter of oversized drill pipe used in the drilling application will depend on the borehole size and the target annular velocity. The target annular velocity should be greater than the slip velocity of the suspended cuttings and debris in the return mud. The slip velocity of the cuttings and debris is generally determined to be approximately 25 FPM. The minimum target annular velocity would therefore be approximately 100 FPM, with an optimum target annular velocity of 150 FPM. In calculating the target annular velocity of the return mud, it is critical not to achieve too high of an annular velocity. Should the value surpass the laminar flow threshold, the return mud will become a turbulent stream thereby risking damage to the formation.

Figure 9A:
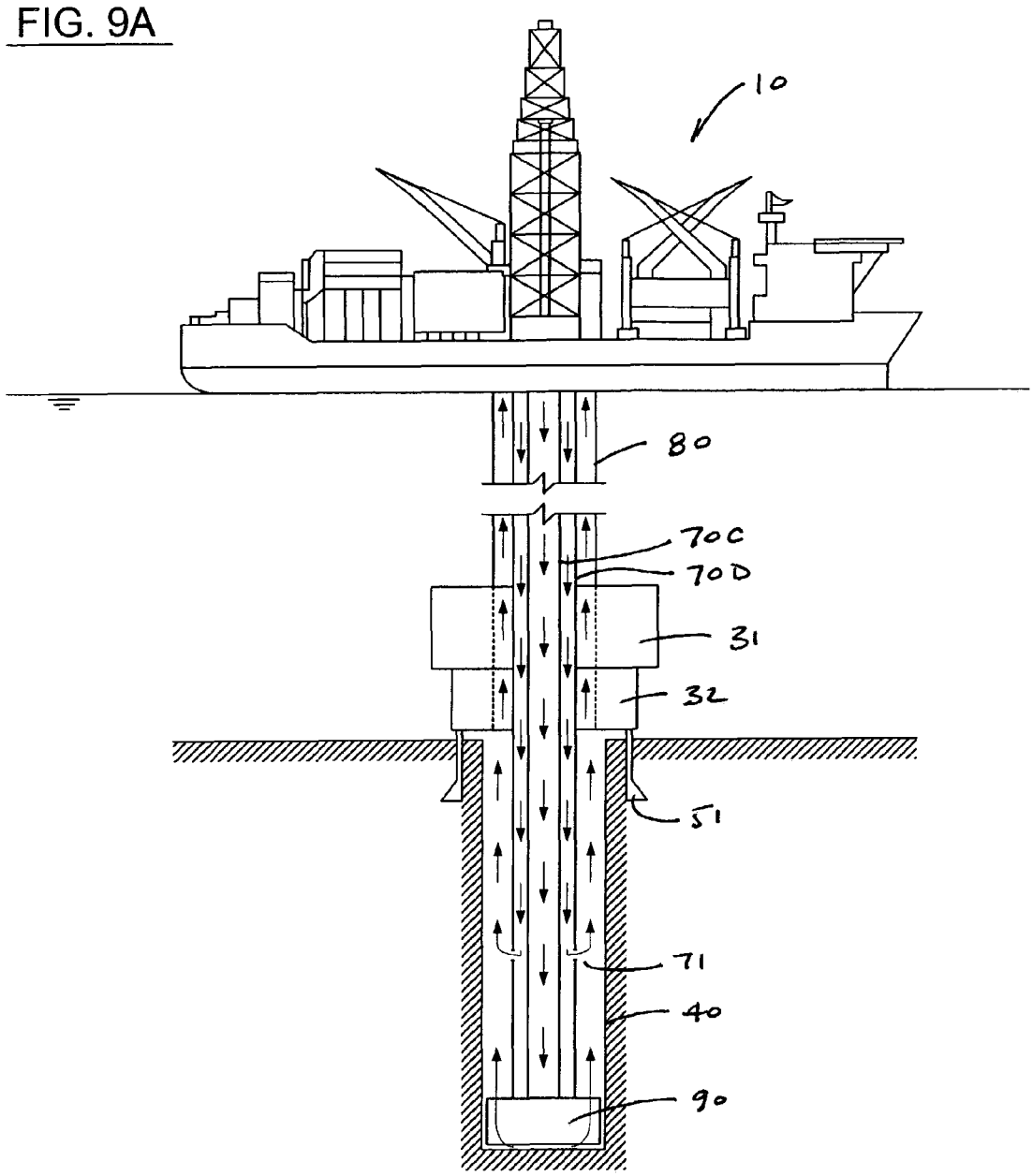
FIG. 9A is a schematic of an offshore drilling system depicting a concentric drill string employed to inject drilling fluid in accordance with the present invention.
Figure 9B:
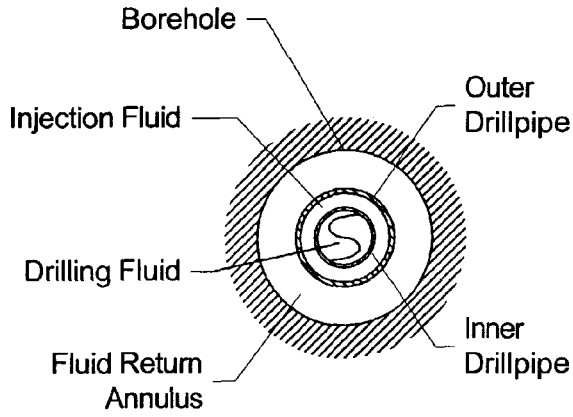
FIG. 9B is an enlarged cross-sectional view of a concentric drill string in accordance with the present invention.

In another embodiment of the present invention, instead of delivering the base fluid through a wellhead injection apparatus, the base fluid may be delivered via a concentric drill string. With respect to FIGS. 9A and 9B, a concentric drill string comprises an inner string of drill pipe 70C arranged within an outer string of drill pipe 70D. For example, the inner drill string 70C may comprise a string of drill pipes having an outer diameter of 2⅞" and the outer drill pipe 70D may comprise a string of drill pipes having an outer diameter of 5½". The size of the inner drill string 70C and outer drill string 70D may vary from 2⅞" to 9⅞" depending on the requirements of the well. The concentric drill string may be used to both (1) deliver drilling fluid to the drill bit 90 and bottom of borehole 40 via the inner drill string 70C, and (2) inject base fluid into the return mud stream via a set of ports 71 formed in the outer drill string 70D. The base fluid is actually injected from the surface rig 10 into the annular space between the inner drill string 70C and the outer drill string 70D. The combination return mud is then returned to the surface via the riser 80. While the preferred embodiment of the concentric drill string of the present invention is described as being used to circulate drilling fluid to the bottom of the hole via the inner drill pipe and to inject a base fluid into the return mud stream via a set of ports in the outer drill pipe, it is intended that the present invention includes another embodiment where the drilling fluid is circulated to the bottom of the hole via the outer drill pipe and the base fluid is injected into the return mud stream via a set of ports which establish communication between the borehole and the inner drill pipe by spanning the outer drill pipe. Moreover, while this embodiment of the concentric drill string of the present invention includes only one injection point, it is intended that a concentric drill string may include a plurality of axially spaced injection points which may be regulated by valves controlled at the surface or by convention drop ball actuation. Each valve may be moved between an open position to facilitate base fluid injection or a closed position to block injection.

Figure 10:
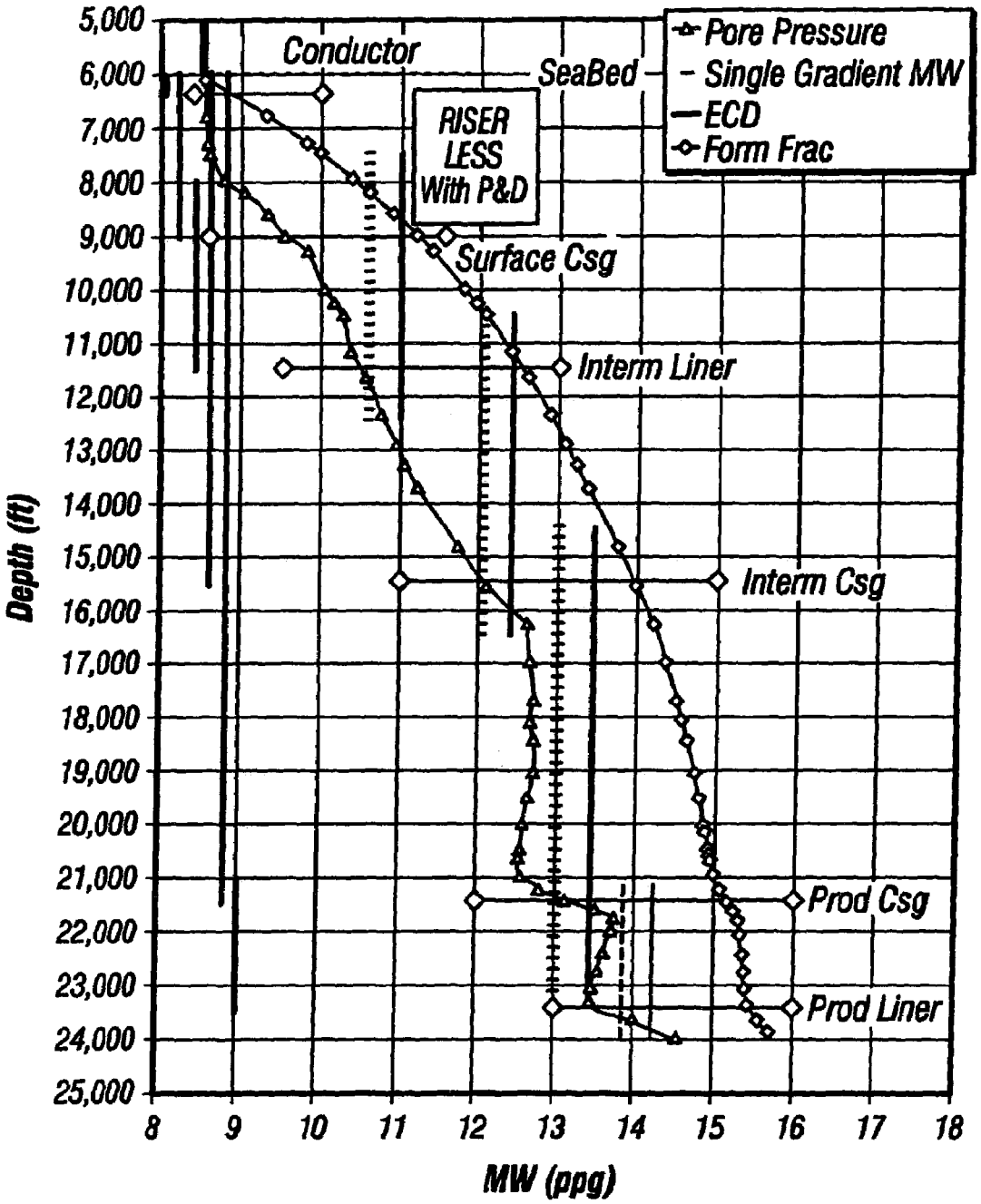
FIG. 10 is a graph showing depth versus down hole pressures in a single gradient drilling mud application.
Figure 11:
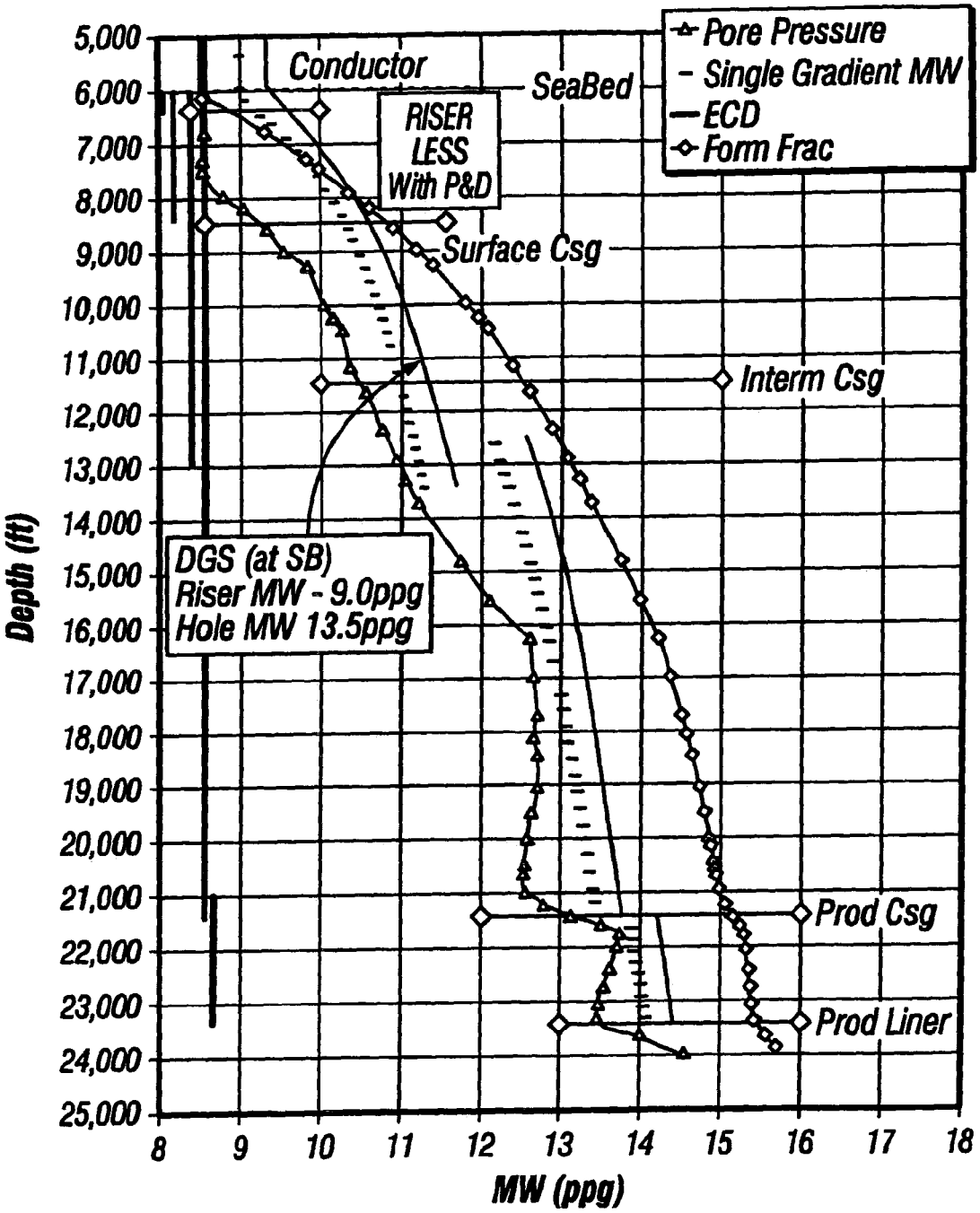
FIG. 11 is a graph showing depth versus down hole pressures and illustrates the advantages obtained using multiple density muds injected at the seabed versus a single gradient mud.
Figure 12:
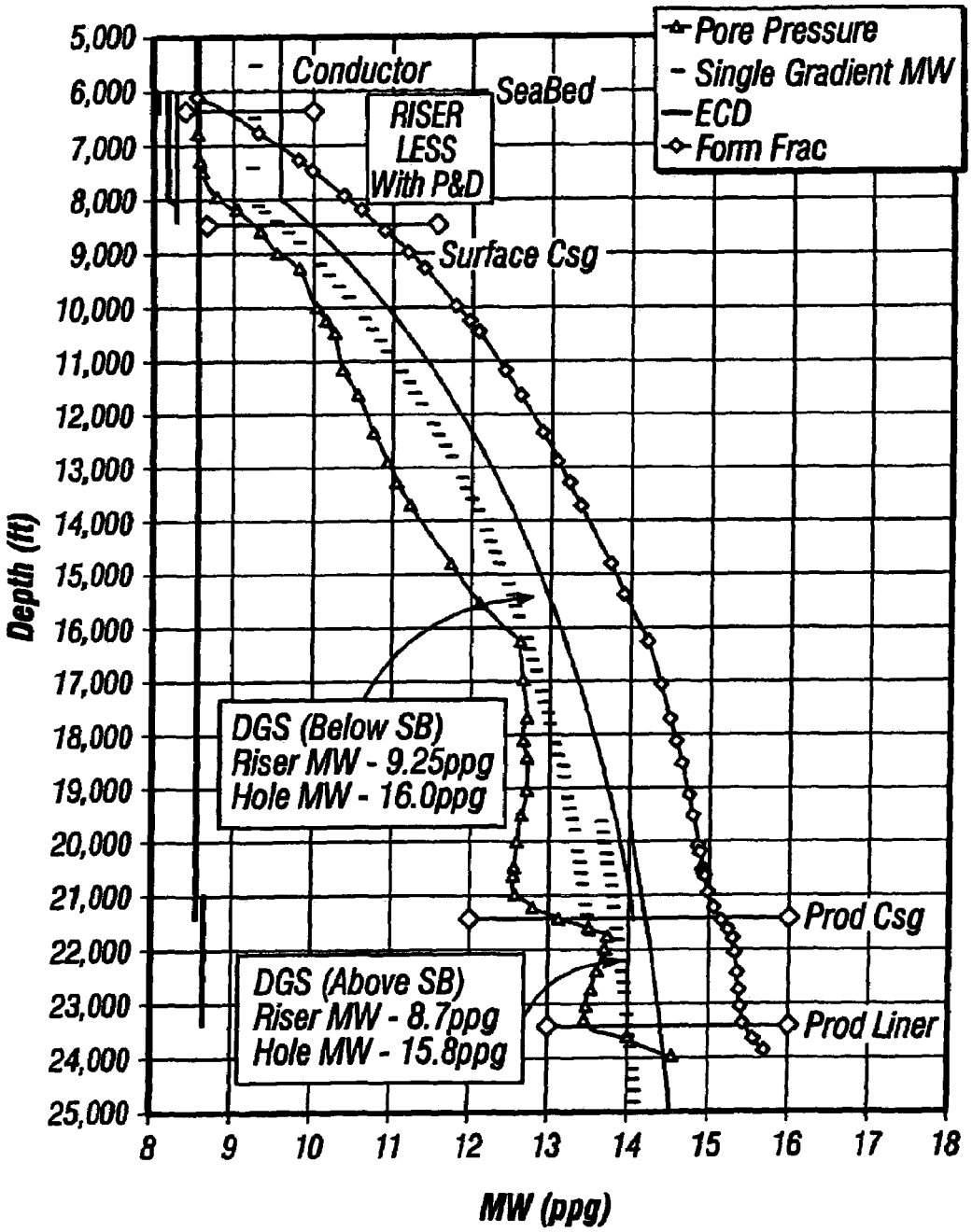
FIG. 12 is a graph showing depth versus down hole pressures and illustrates the advantages obtained using multiple density muds injected below the seabed versus a single gradient mud.

An example of the advantages achieved using the dual density mud system (light base fluid injection) of the present invention is shown in the graphs of FIGS. 10–12. The graph of FIG. 10 depicts casing setting depths with single gradient mud; the graph of FIG. 11 depicts casing setting depths with dual gradient mud (light base fluid injection) inserted at the seabed; and the graph of FIG. 12 depicts casing setting depths with dual gradient mud (light base fluid injection) inserted below the seabed. The graphs of FIGS. 10–12 demonstrate the advantages of using a dual gradient mud (light base fluid injection) over a single gradient mud. The vertical axis of each graph represents depth and shows the seabed or sea floor at approximately 6,000 feet. The horizontal axis represents mud weight in pounds per gallon or "PPG". The solid line represents the "equivalent circulating density" (ECD) in PPG. The diamonds represents formulation frac pressure. The triangles represent pore pressure. The bold vertical lines on the far left side of the graph depict the number of casings required to drill the well with the corresponding drilling mud at a well depth of approximately 23,500 feet. With respect to FIG. 10, when using a single gradient mud, a total of six casings are required to reach total depth (conductor, surface casing, intermediate liner, intermediate casing, production casing, and production liner). With respect to FIG. 11, when using a dual gradient mud inserted at or just above the seabed, a total of five casings are required to reach total depth (conductor, surface casing, intermediate casing, production casing, and production liner). With respect to FIG. 12, when using a dual gradient mud inserted approximately 2,000 feet below the seabed, a total of four casings are required to reach total depth (conductor, surface casing, production casing, and production liner). By reducing the number of casings run and installed downhole, it will be appreciated by one of skill in the art that the number of rig days and the total well cost will be decreased.

Figure 13:
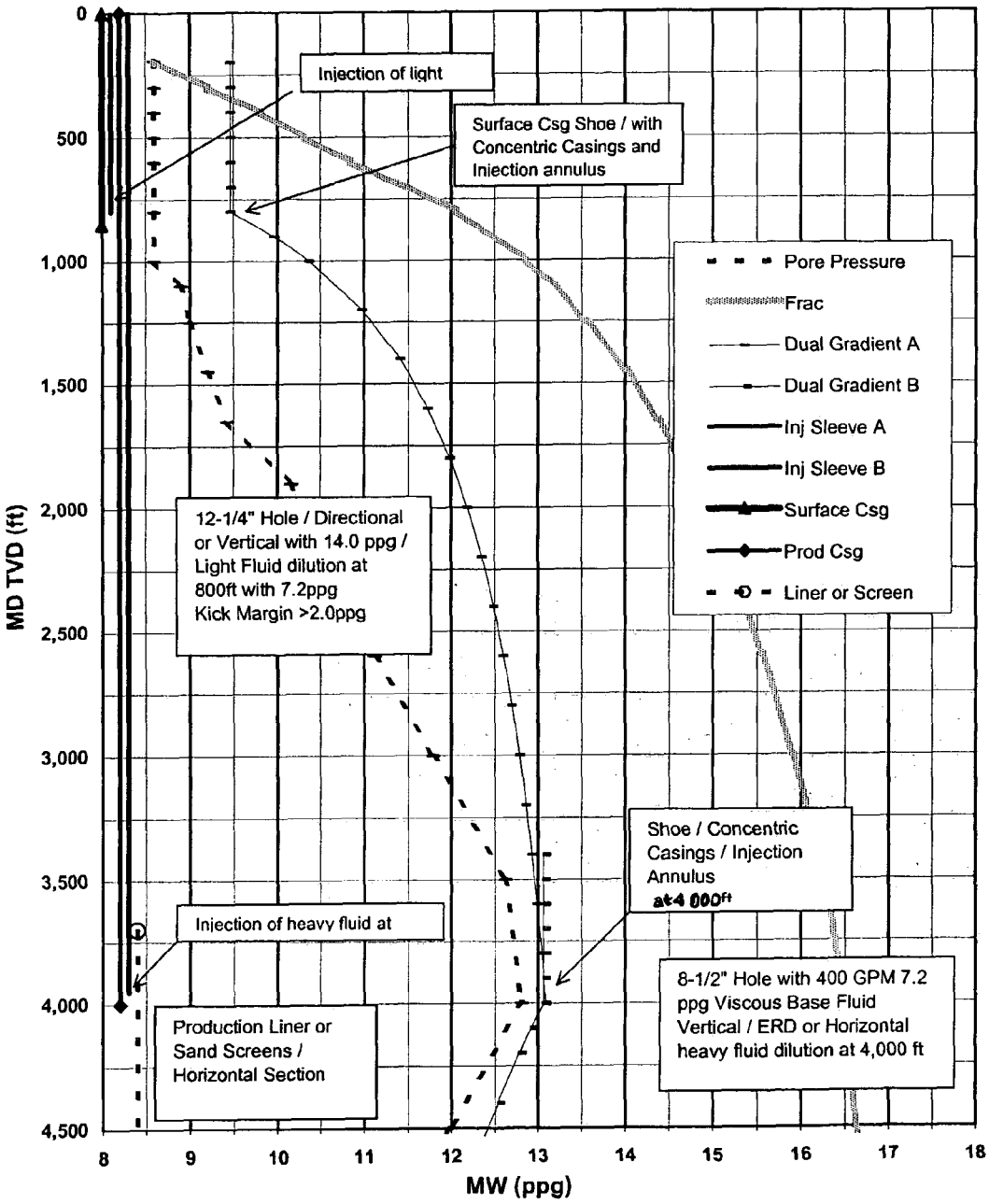
FIG. 13 is a graph showing depth versus down hole pressures and illustrates the advantages obtained by drilling with a light mud once the production zone is reached and injecting a heavy mud over the column of light return mud.

Moreover, an example of the advantages achieved using a light drilling fluid to drill with once the production zone is breached and injecting a heavy base fluid to weight down the return mud and thus protect the well head is shown in the graph of FIG. 13. The graph of FIG. 13 depicts casing setting depths with injecting a light base fluid into the return mud stream before the production zone (or sand screen or horizontal section) is reached, and then drilling with a light drilling fluid and injecting a heavy base fluid once the production zone (or sand screen or horizontal section) is reached. The vertical axis of the graph represents depth and the horizontal axis represents mud weight in pounds per gallon or "PPG". With respect to FIG. 13, when using this system, a total of four casings are required to reach total depth (surface casing, production casing and two injection sleeves). Again, by reducing the number of casings run and installed downhole, it will be appreciated by one of skill in the art that the number of rig days and the total well cost will be decreased.

In dual gradient drilling operations, as with conventional single gradient drilling operations, a primary function of drilling fluid is to provide hydrostatic well control. While overbalanced drilling operations include maintaining a hydrostatic pressure on the formation equal to or slightly greater than the pore pressure of the formation, underbalanced drilling operations include maintaining a hydrostatic pressure at least slightly lower than the pore pressure of the formation. As well depth increases, hydrostatic pressure at the bottom of the wellbore likewise increases which may result in a formation fluid influx into the wellbore (called a "kick"). When a kick is taken, the invading formation liquid and/or gas may "cut" or decrease the density of the drilling fluid in the wellbore. If the kick is not contained and more formation fluid enters the wellbore, then hydrostatic control of the wellbore could be lost.

When a kick is taken in a dual gradient drilling system, like that of the present invention, conventional well-killing techniques may be utilized to regain control of the well as with conventional single gradient drilling systems. Two variations of a conventional well-killing technique are described in U.S. Pat. No. 6,484,816 entitled "Method and System for Controlling Wellbore Pressure," issued on Nov. 26, 2002 to William L. Koederitz, which is incorporated herein by reference. These variations may be used to kill a well being drilled with dual gradient mud.

When a kick is detected, dual gradient well drilling and circulation is halted and the wellbore is shut in. The "Constant Bottom Hole Pressure" method, whereby bottom hole pressure may be maintained substantially at or above formation pore pressure, may be employed to kill the well. There are two variations of the Constant Bottom Hole Pressure method—the "Driller's method" and the "Engineer's method" (also called the "Weight and Wait" method).

In the Driller's method, the original mud weight is used to circulate the contaminating formation fluid from the wellbore. Thereafter, kill weight mud is circulated through the drill and into the wellbore. Thus, in the Driller's method, two circulations are required, but the first circulation of original drilling fluid may be commenced while the kill weight mud is being calculated and prepared.

In the Engineer's method, the kill weight mud is calculated and prepared and then circulated through the drill string and into the wellbore to remove the contaminating formation fluid from the wellbore and to kill the well. This method requires only one circulation and maybe preferable to the Driller's method as it maintains the lowest casing pressure during circulating the kick from the wellbore and may thereby minimize the risk of damaging the casing or fracturing the formation and creating an underground blowout.

In still another embodiment of the present invention, the mud recirculation system includes a treatment system located at the surface for: (1) receiving the return combined mud (with density Mr), (2) removing the drill cuttings from the mud, and (3) stripping the lighter base fluid (with density Mb) from the return mud to achieve the initial heavier drilling fluid (with density Mi).

Figure 14:
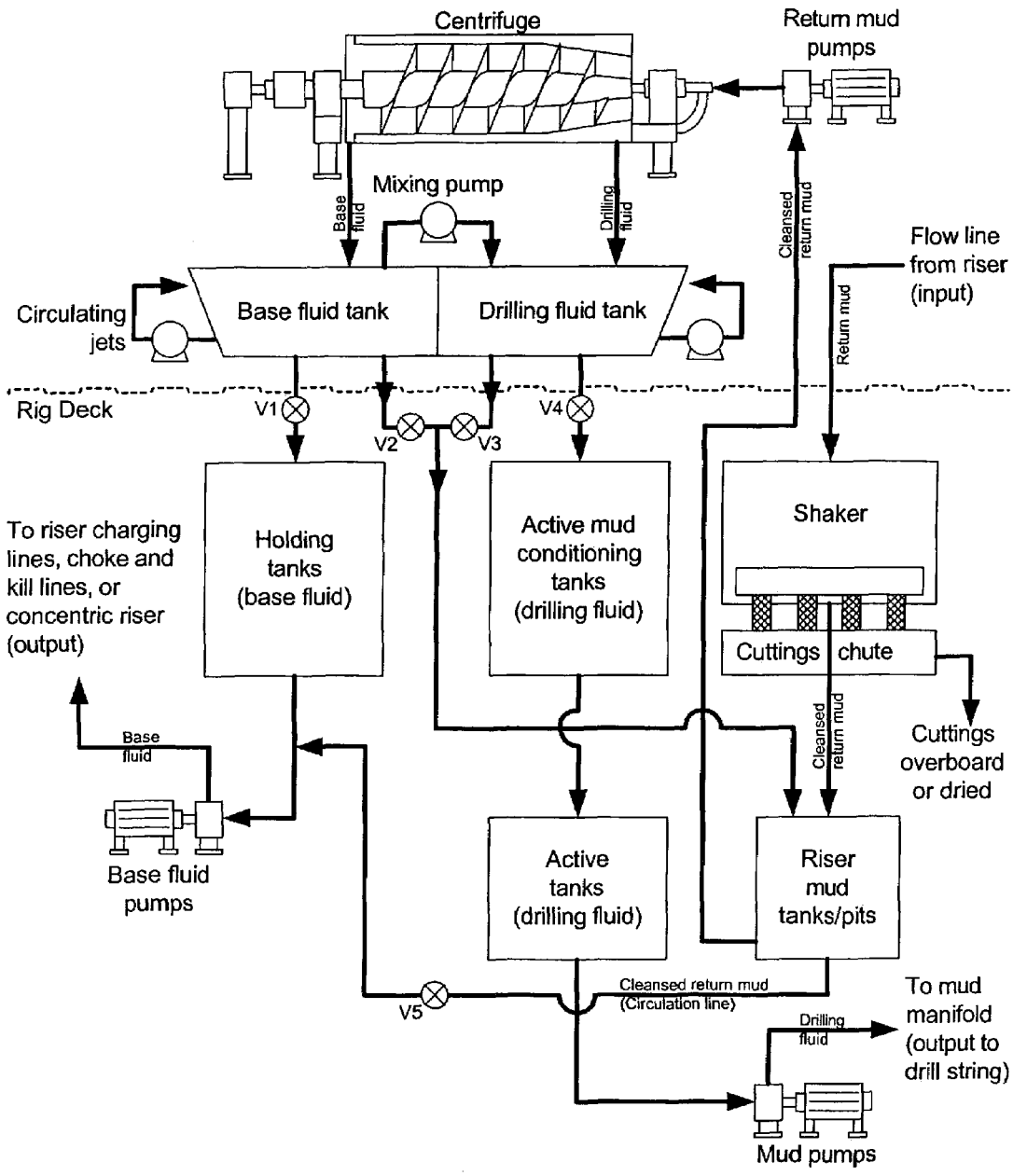
FIG. 14 is a diagram of the drilling mud treatment system in accordance with the present invention for stripping the base fluid from the drilling mud at or above the seabed.

With respect to FIG. 14, the treatment system of the present invention includes: (1) a shaker device for separating drill cuttings from the return mud, (2) a set of riser fluid tanks or pits for receiving the cleansed return mud from the shaker, (3) a separation skid located on the deck of the drilling rig—which comprises a centrifuge, a set of return mud pumps, a base fluid collection tank and a drilling fluid collection tank—for receiving the cleansed return mud and separating the mud into a drilling fluid component and a base fluid component, (4) a set of holding tanks (e.g. hull tanks) for storing the stripped base fluid component, (5) a set of base fluid pumps for re-inserting the base fluid into the riser stream via the charging line, (6) a set of conditioning tanks for adding mud conditioning agents to the drilling fluid component, (7) a set of active tanks for storing the drilling fluid component, and (8) a set of mud pumps to pump the drilling fluid into the wellbore via the drill string.

In operation, the return mud is first pumped from the riser into the shaker device having an inlet for receiving the return mud via a flow line connecting the shaker inlet to the riser. Upon receiving the return mud, the shaker device separates the drill cuttings from the return mud producing a cleansed return mud. The cleansed return mud flows out of the shaker device via a first outlet, and the cuttings are collected in a chute and bourn out of the shaker device via a second outlet. Depending on environmental constraints, the cuttings may be dried and stored for eventual off-rig disposal or discarded overboard.

The cleansed return mud exits the shaker device and enters the set of riser mud tanks/pits via a first inlet. The set of riser mud tanks/pits holds the cleansed return mud until it is ready to be separated into its basic components—drilling fluid and base fluid. The riser mud tanks/pits include a first outlet through which the cleansed mud is pumped out.

The cleansed return mud is pumped out of the set of riser mud tanks/pits and into the centrifuge device of the separation skid by a set of return mud pumps. While the preferred embodiment includes a set of six return mud pumps, it is intended that the number of return mud pumps used may vary depending upon on drilling constraints and requirements. The separation skid includes the set of return mud pumps, the centrifuge device, a base fluid collection tank for gathering the lighter base fluid, and a drilling fluid collection tank to gather the heavier drilling mud.

Figure 16:
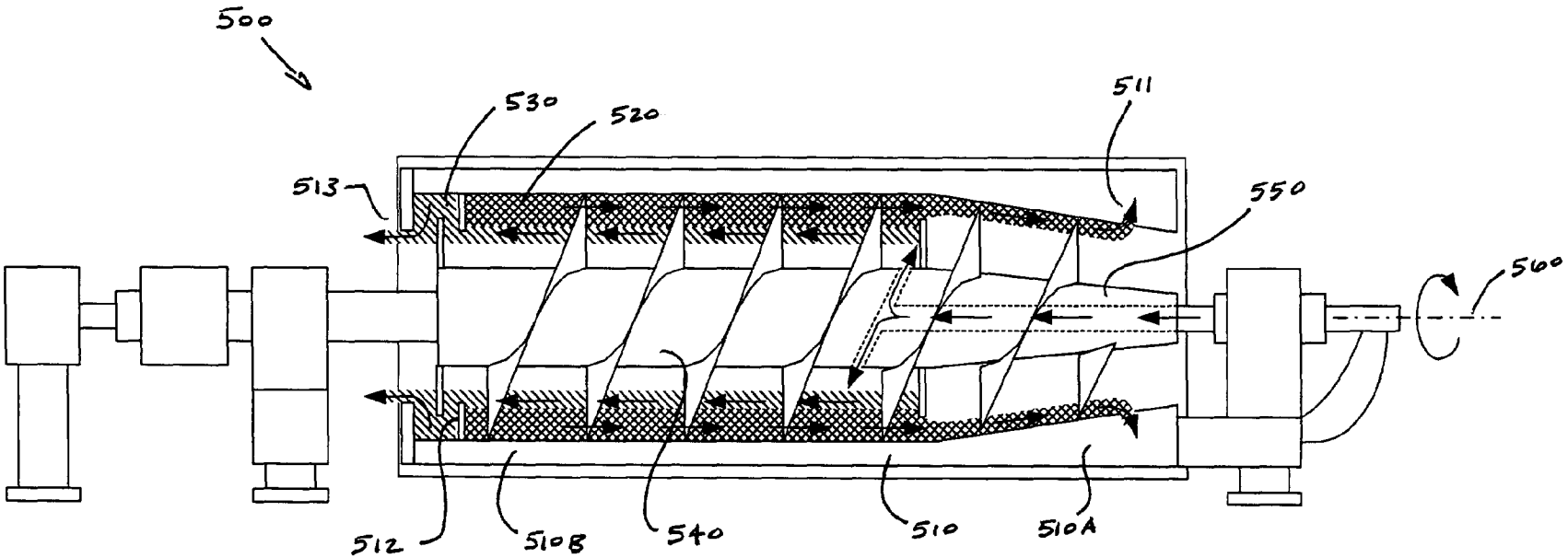
FIG. 16 is an enlarged elevation view of a conventional solid bowl centrifuge as used in the treatment system of the present invention to separate the low-density material from the high-density material in the return mud.

As shown in FIG. 16, the centrifuge device 500 includes: (1) a bowl 510 having a tapered end 510A with an outlet port 511 for collecting the high-density fluid 520 and a non-tapered end 510B having an adjustable weir plate 512 and an outlet port 513 for collecting the low-density fluid 530, (2) a helical (or "screw") conveyor 540 for pushing the heavier density fluid 520 to the tapered end 510A of the bowl 510 and out of the outlet port 511, and (3) a feed tube 550 for inserting the return mud into the bowl 510. The conveyor 540 rotates along a horizontal axis of rotation 560 at a first selected rate and the bowl 510 rotates along the same axis at a second rate which is relative to but generally faster than the rotation rate of the conveyor.

The cleansed return mud enters the rotating bowl 510 of the centrifuge device 500 via the feed tube 550 and is separated into layers 520, 530 of varying density by centrifugal forces such that the high-density layer 520 (i.e., the drilling fluid with density Mi) is located radially outward relative to the axis of rotation 560 and the low-density layer 530 (i.e., the base fluid with density Mb) is located radially inward relative to the high-density layer. The weir plate 512 of the bowl is set at a selected depth (or "weir depth") such that the drilling fluid 520 cannot pass over the weir and instead is pushed to the tapered end 510A of the bowl 510 and through the outlet port 511 by the rotating conveyor 540. The base fluid 530 flows over the weir plate 512 and through the outlet 513 of the non-tapered end 510B of the bowl 510. In this way, the return mud is separated into its two components: the base fluid with density Mb and the drilling fluid with density Mi.

The base fluid is collected in the base fluid collection tank and the drilling fluid is collected in the drilling fluid collection tank. In a preferred embodiment of the present invention, both the base fluid collection tank and the drilling fluid collection tank include a set of circulating jets to circulate the fluid inside the tanks to prevent settling of solids. Also, in a preferred embodiment of the present invention, the separation skid includes a mixing pump which allows a predetermined volume of base fluid from the base fluid collection tank to be added to the drilling fluid collection tank to dilute and lower the density of the drilling fluid.

The base fluid collection tank includes a first outlet for moving the base fluid into the set of holding tanks and a second outlet for moving the base fluid back into the set of riser mud tanks/pits if further separation is required. If valve V1 is open and valve V2 is closed, the base fluid will feed into the set of holding tanks for storage. If valve V1 is closed and valve V2 is open, the base fluid will feed back into the set of riser fluid tanks/pits to be run back through the centrifuge device.

Each of the holding tanks includes an inlet for receiving the base fluid and an outlet. When required, the base fluid can be pumped from the set of holding tanks through the outlet and re-injected into the riser mud at a location at or below the seabed via the riser charging lines using the set of base fluid pumps.

The drilling fluid collection tank includes a first outlet for moving the drilling fluid into the set of conditioning tanks and a second outlet for moving the drilling fluid back into the set of riser mud tanks/pits if further separation is required. If valve V3 is open and valve V4 is closed, the drilling fluid will feed into the set of conditioning tanks. If valve V3 is closed and valve V4 is open, the drilling fluid will feed back into the set of riser fluid tanks/pits to be run back through the centrifuge device.

Each of the active mud conditioning tanks includes an inlet for receiving the drilling fluid component of the return mud and an outlet for the conditioned drilling fluid to flow to the set of active tanks. In the set of conditioning tanks, mud conditioning agents may be added to the drilling fluid. Mud conditioning agents (or "thinners") are generally added to the drilling fluid to reduce flow resistance and gel development in clay-water muds. These agents may include, but are not limited to, plant tannins, polyphosphates, lignitic materials, and lignosulphates. Also, these mud conditioning agents may be added to the drilling fluid for other functions including, but not limited to, reducing filtration and cake thickness, countering the effects of salt, minimizing the effect of water on the formations drilled, emulsifying oil in water, and stabilizing mud properties at elevated temperatures.

Once conditioned, the drilling fluid is fed into a set of active tanks for storage. Each of the active tanks includes an inlet for receiving the drilling fluid and an outlet. When required, the drilling fluid can be pumped from the set of active tanks through the outlet and into the drill string via the mud manifold using a set of mud pumps.

While the treatment system of the present invention is described with respect to stripping a base fluid from the return mud, it is intended that treatment system can be used to strip any material—fluid or solid—having a density different than the density of the drilling fluid from the return mud. For example, drilling mud in a single density drilling fluid system or "total mud system" comprising a base fluid with barite can be separated into a base fluid component and a barite component using the treatment system of the present invention. In a total mud system, each section of the well is drilled using a drilling mud having a single, constant density. However, as deeper sections of the well are drilled, it is required to use a mud having a density greater than that required to drill the shallower sections. More specifically, the shallower sections of the well may be drilled using a drilling mud having a density of 10 PPG, while the deeper sections of the well may require a drilling mud having a density of 12 PPG. In previous operations, once the shallower sections of the well were drilled with 10 PPG mud, the mud would be shipped from the drilling rig to a location onshore to be treated with barite to form a denser 12 PPG mud. After treatment, the mud would be shipped back offshore to the drilling rig for use in drilling the deeper sections of the well. The treatment system of the present invention, however, may be used to treat the 10 PPG density mud to obtain the 12 PPG density mud without having the delay and expense of sending the mud to and from a land-based treatment facility. This may be accomplished by using the separation unit to draw off and store the base fluid from the 10 PPG mud, thus increasing the concentration of barite in the mud until a 12 PPG mud is obtained. The deeper sections of the well can then be drilled using the 12 PPG mud. Finally, when the well is complete and a new well is begun, the base fluid can be combined with the 12 PPG mud to reacquire the 10 PPG mud for drilling the shallower sections of the new well. In this way, valuable components—both base fluid and barite—of a single gradient mud may be stored and combined at a location on the rig to efficiently create a mud tailored to the drilling requirement of a particular section of the well.

While the treatment system of the present invention is described with respect to stripping the light density base fluid from the combination return mud to obtain the original drilling fluid to be recirculated through the drill bit and the light base fluid to be reinjected into the return mud stream (as shown in FIGS. 1–2), it is intended that the treatment system of the present invention can be used to strip the light drilling fluid from a combination return mud to obtain the original light drilling fluid to be recirculated through the drill bit and the heavy base fluid to be reinjected into the return mud column (as shown in FIGS. 4–6).

In still another embodiment of the present invention, the treatment system includes a circulation line for boosting the riser fluid with drilling fluid of the same density in order to circulate cuttings out the riser. As shown in FIG. 14, when the valve V5 is open, cleansed riser return mud can be pumped from the set of riser mud tanks or pits and injected into the riser stream at a location at or below the seabed. This is performed when circulation downhole below the seabed has stopped thru the drill string and no dilution is required.

Figure 15:
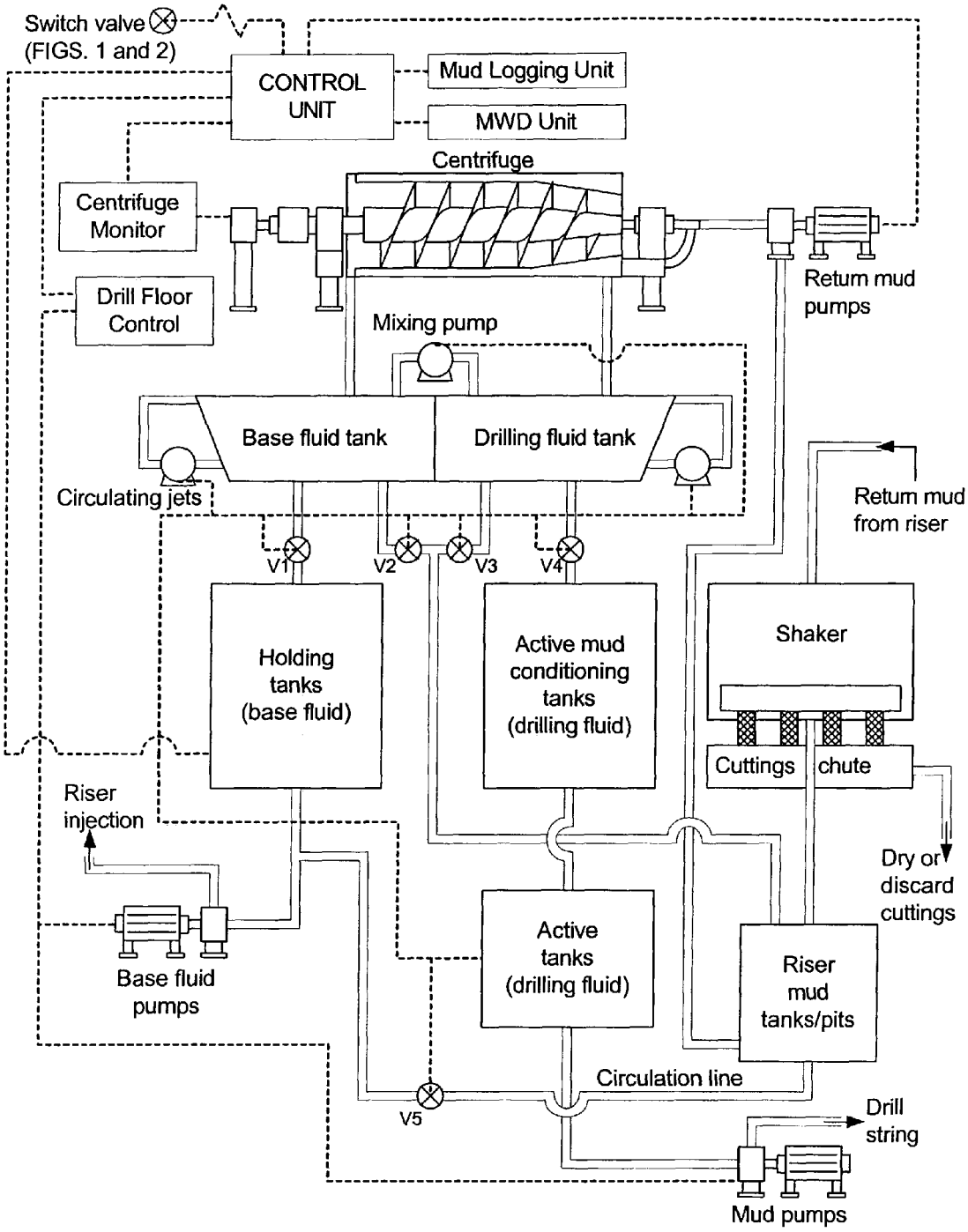
FIG. 15 is a diagram of control system for monitoring and manipulating variables for the drilling mud treatment system of the present invention.

In yet another embodiment of the present invention, the mud recirculation system includes a multi-purpose software-driven control unit for manipulating drilling fluid systems and displaying drilling and drilling fluid data. With respect to FIG. 15, the control unit is used for manipulating system devices such as: (1) opening and closing the switch valves 101 (FIGS. 1 and 2) or 100A and 100B (FIG. 6), the control valves V1, V2, V3, and V4, and the circulation line valve V5, (2) activating, deactivating, and controlling the rotation speed of the set of mud pumps, the set of return mud pumps, and the set of base fluid pumps, (3) activating and deactivating the circulation jets, and (4) activating and deactivating the mixing pump. Also, the control unit may be used to adjust centrifuge variables including feed rate, bowl rotation speed, conveyor speed, and weir depth in order to manipulate the heavy fluid discharge.

Furthermore, the control unit is used for receiving and displaying key drilling and drilling fluid data such as: (1) the level in the set of holding tanks and set of active tanks, (2) readings from a measurement-while-drilling (or "MWD") instrument, (3) readings from a pressure-while-drilling (or "PWD") instrument, and (4) mud logging data.

A MWD instrument is used to measure formation properties (e.g., resistivity, natural gamma ray, porosity), wellbore geometry (e.g., inclination and azimuth), drilling system orientation (e.g., toolface), and mechanical properties of the drilling process. A MWD instrument provides real-time data to maintain directional drilling control.

A PWD instrument is used to measure the differential well fluid pressure in the annulus between the instrument and the wellbore while drilling mud is being circulated in the wellbore. A PWD unit provides real-time data at the surface of the well indicative of the pressure drop across the bottom hole assembly for monitoring motor and MWD performance.

Mud logging is used to gather data from a mud logging unit which records and analyzes drilling mud data as the drilling mud returns from the wellbore. Particularly, a mud logging unit is used for analyzing the return mud for entrained oil and gas, and for examining drill cuttings for reservoir quality and formation identification.

While certain features and embodiments have been described in detail herein, it should be understood that the invention includes all of the modifications and enhancements within the scope and spirit of the following claims.

In the afore specification and appended claims: (1) the term "tubular member" is intended to embrace "any tubular good used in well drilling operations" including, but not limited to, "a casing", "a subsea casing", "a surface casing", "a conductor casing", "an intermediate liner", "an intermediate casing", "a production casing", "a production liner", "a casing liner", or "a riser"; (2) the term "drill tube" is intended to embrace "any drilling member used to transport a drilling fluid from the surface to the wellbore" including, but not limited to, "a drill pipe", "a string of drill pipes", or "a drill string"; (3) the terms "connected", "connecting", "connection", and "operatively connected" are intended to embrace "in direct connection with" or "in connection with via another element"; (4) the term "set" is intended to embrace "one" or "more than one"; (5) the term "charging line" is intended to embrace any auxiliary riser line, including but not limited to "riser charging line", "booster line", "choke line", "kill line", or "a high-pressure marine concentric riser"; (6) the term "system variables" is intended to embrace "the feed rate, the rotation speed of the set of mud pumps, the rotation speed of the set of return mud pumps, the rotation speed of the set of base fluid pumps, the bowl rotation speed of the centrifuge, the conveyor speed of the centrifuge, and/or the weir depth of the centrifuge"; (7) the term "drilling and drilling fluid data" is intended to embrace "the contained volume in the set of holding tanks, the contained volume in the set of active tanks, the readings from a MWD instrument, the readings from a PWD instrument, and mud logging data"; and (8) the term "tanks" is intended to embrace "tanks" or "pits".

What is claimed is:

1. A method for balancing the pressure in a wellbore defined by a first end adjacent the surface and a second end below the surface, said wellbore having a drill string extending from above the wellbore to a location adjacent the second end of said wellbore, said method comprising the steps of:

(a) introducing a first fluid having a first density into the drillstring;

(b) discharging said first fluid from said drill string adjacent the second end of said wellbore to form a first colunm of fluid within said wellbore;

(c) introducing a second fluid having a second density greater than the first density into said wellbore at a location removed from said second end of said wellbore to form a second column of fluid within said wellbore, wherein said second column of fluid is formed between said first colunm and said first end of said wellbore;

(d) establishing a gradient between said first and second columns; and (e) adjusting said second column to adjust fluid balancing in the wellbore.

2. The method of claim 1, wherein the step of adjusting comprises altering the density of at least one of said fluids.

3. The method of claim 1, wherein the step of adjusting comprises altering the volume of the second column.

4. The method of claim 1, wherein the step of adjusting is adapted to facilitate underbalanced drilling operations.

5. The method of claim 1, wherein the step of adjusting is adapted to facilitate near-balanced drilling operations.

6. A method for balancing the pressure in a wellbore defined by a first end adjacent the surface and a second end below the surface, and further having a cased portion extending down form said first end and an uncased portion adjacent said second end said wellbore having a drill string extending from above the wellbore to a location adjacent the second end of said wellbore, said method comprising the steps of:

(a) introducing a first fluid having a first density into the drillstring;

(b) discharging said first fluid from said drill string adjacent the second end of said wellbore to form a first column of fluid within said wellbore;

(c) introducing a second fluid having a second density greater than the first density into said wellbore at a location removed from said second end of said wellbore to form a second column of fluid within said wellbore, wherein said second column of fluid is formed between said first column and said first end of said wellbore;

(d) establishing a gradient between said first and second columns, (e) wherein an extraction member is positioned in said wellbore within the cased portion of the wellbore at a location removed from said second end of said wellbore and said second column is balanced so as to cause said first fluid to flow upward through said extraction member.

* * * * *